US008395463B2

(12) United States Patent
Ito et al.

(10) Patent No.: US 8,395,463 B2
(45) Date of Patent: Mar. 12, 2013

(54) CONTACT DEVICE

(75) Inventors: Masahiro Ito, Ise (JP); Ritsu Yamamoto, Kyotanabe (JP); Motoharu Kubo, Obihiro (JP); Tsukasa Nishimura, Katou-gun (JP)

(73) Assignee: Panasonic Corporation, Osaka (JP)

( * ) Notice: Subject to any disclaimer, the term of this patent is extended or adjusted under 35 U.S.C. 154(b) by 192 days.

(21) Appl. No.: 12/933,135

(22) PCT Filed: Mar. 16, 2009

(86) PCT No.: PCT/JP2009/055054

§ 371 (c)(1),
(2), (4) Date: Sep. 17, 2010

(87) PCT Pub. No.: WO2009/116493

PCT Pub. Date: Sep. 24, 2009

(65) Prior Publication Data

US 2011/0032059 A1 Feb. 10, 2011

(30) Foreign Application Priority Data

Mar. 19, 2008 (JP) ..... 2008-072257
Mar. 19, 2008 (JP) ..... 2008-072258
Mar. 19, 2008 (JP) ..... 2008-072259
Mar. 19, 2008 (JP) ..... 2008-072260

(51) Int. Cl.
*H01H 51/22* (2006.01)

(52) U.S. Cl. ..... 335/78; 335/202; 335/251

(58) Field of Classification Search ..... 335/78–86, 335/126–132, 251, 202
See application file for complete search history.

(56) References Cited

U.S. PATENT DOCUMENTS 5,392,015 A 2/1995 Matsuoka et al.
5,892,194 A * 4/1999 Uotome et al. ..... 218/68
6,657,150 B1 12/2003 Shea et al.
2004/0130418 A1 7/2004 Tsutsui et al.
2007/0241847 A1 10/2007 Yamamoto et al.

FOREIGN PATENT DOCUMENTS

JP 56-26916 U 3/1981
JP 61-77312 A 4/1986

(Continued)

OTHER PUBLICATIONS

International Search Report for Application No. PCT/JP2009/055054 mailed Jun. 16, 2009.

(Continued)

*Primary Examiner* — Bernard Rojas
(74) *Attorney, Agent, or Firm* — McDermott Will & Emery LLP

(57) ABSTRACT

A sealed receptacle includes a case, a cylindrical member, and a closure plate. The sealed receptacle is configured to house a fixed contact, a movable contact, and an arc protection member. The arc protection member includes a peripheral wall, and a bottom. The peripheral wall is configured to conceal a junction between the case and the cylindrical member from the fixed contact and the movable contact. The bottom is interposed between the movable contact and the closure plate. The sealed receptacle houses a contact pressure provision member configured to bias the movable contact to come into contact with the fixed contact. The contact pressure provision member is interposed between the movable contact and the bottom so as to come into resilient contact with both the movable contact and the bottom irrespective of a position of the movable contact.

14 Claims, 20 Drawing Sheets

FOREIGN PATENT DOCUMENTS

| | | | |
|---|---|---|---|
| JP | 2-44176 | U | 3/1990 |
| JP | 2-75424 | A | 3/1990 |
| JP | 5-325760 | A | 12/1993 |
| JP | 6-283087 | A | 10/1994 |
| JP | 9-283331 | A | 10/1997 |
| JP | 10-326530 | A | 12/1998 |
| JP | 2001-61722 | A | 3/2001 |
| JP | 2001-259192 | A | 9/2001 |
| JP | 2004-172036 | A | 6/2004 |
| JP | 2005-26183 | A | 1/2005 |
| JP | 2005-100779 | A | 4/2005 |
| JP | 2005-264761 | A | 9/2005 |
| JP | 2005-347720 | A | 12/2005 |
| JP | 2006-261056 | A | 9/2006 |
| JP | 2007-257997 | A | 10/2007 |
| JP | 2007-287526 | A | 11/2007 |
| WO | WO-2006/104080 | A1 | 10/2006 |

OTHER PUBLICATIONS

Notification of Reasons for Refusal for Application No. 2008-072257 from Japan Patent Office mailed Aug. 31, 2010.

Notification of Reasons for Refusal for Application No. 2008-072259 from Japan Patent Office mailed Aug. 31, 2010.

Notification of Reasons for Refusal for Application No. 2008-072260 from Japan Patent Office mailed Aug. 31, 2010.

Notification of Reasons for Refusal for Application No. 2008-072260 from Japan Patent Office mailed May 31, 2011.

Canadian Office Action for the Application No. 2,718,970 from the Canadian Intellectual Property Office dated Aug. 31, 2011.

Canadian Office Action or the Application No. 2 718 970 dated Aug. 31, 2012.

* cited by examiner

CONTACT DEVICE

TECHNICAL FIELD

The present invention is directed to contact devices, and more particularly to a contact device suitable for a relay or electromagnetic switch for power loads.

BACKGROUND ART

As shown in FIG. 25A, a prior contact device 1000 includes a sealed receptacle 1100 (see Japanese patent laid-open publication No. 10-326530). In the following explanation, an upper direction in FIG. 25A denotes a forward direction of the contact device 1000, and a lower direction in FIG. 25A denotes a rearward direction of the contact device 1000.

The sealed receptacle 1100 includes a contact case 1110 made of dielectric materials, a cylindrical member 1120 made of metals, and a closure plate 1130. The contact case 1110 is provided in its rear wall with an aperture 1111. The cylindrical member 1120 has its front end secured in an airtight manner to a periphery of the aperture 1111 of the contact case 1110. The closure plate 1130 is secured in an airtight manner to a rear end of the cylindrical member 1120. The sealed receptacle 1100 houses fixed contacts 1200 and a movable contact 1300.

The contact device 1000 further includes a drive device 1500 having a shaft 1400. The shaft 1400 has its front end attached to a holding case 1600. The holding case 1600 holds the movable contact 1300 movably along the forward/rearward direction. In addition, the holding case 1600 accommodates a contact pressure provision spring 1700. The contact pressure provision spring 1700 biases the movable contact 1300 forward such that the movable contact 1300 comes into contact with the fixed contacts 1200 at a desired contact pressure. The drive device 1500 moves forward/rearward the shaft 1400 by use of an electric magnet. The movable contact 1300 is kept away from the fixed contacts 1200 when the shaft 1400 is moved rearward by a predetermined distance. The movable contact 1300 comes into contact with the fixed contacts 1200 when the shaft 1400 is moved forward by a predetermined distance.

The sealed receptacle 1100 further houses an arc protection member 1140. As shown in FIG. 25B, the arc protection member 1140 includes a peripheral wall 1141 shaped into a cylindrical shape and a flange 1142. The peripheral wall 1141 is configured to conceal a junction between the contact case 1110 and the cylindrical member 1120 from the fixed contacts 1200 and the movable contact 1300. The arc protection member 1140 is pressed forward by pressing springs 11150 such that the flange 1142 comes into contact with the cylindrical member 1120. Thereby, the arc protection member 1140 is held in a predetermined position in the sealed receptacle 1100.

As apparent from the above, the prior contact device 1000 needs the pressing spring 1150 to hold the arc protection member 1140.

DISCLOSURE OF INVENTION

In view of the above insufficiency, the present invention has been aimed to propose a contact device capable of reducing the number of parts necessitated for holding the arc protection member and reducing its production cost.

The contact device in accordance with the present invention includes a sealed receptacle configured to house a fixed contact, a movable contact, and an arc protection member. In addition, the contact device includes a drive unit configured to move the movable contact between an on position and an off position. The on position is defined as a position where the movable contact is kept in contact with the fixed contact. The off position is defined as a position where the movable contact is kept away from the fixed contact. The sealed receptacle includes a case made of dielectric materials, a cylindrical member made of metals, and a closure plate. The case is provided with an aperture in its first wall. The cylindrical member has its first axial end secured in an airtight manner to a periphery of the aperture of the case. The closure plate is secured in an airtight manner to a second axial end of the cylindrical member. The fixed contact is fixed to a second wall of the case which is opposed to the first wall of the case. The movable contact is interposed between the fixed contact and the closure plate. The arc protection member includes a peripheral wall configured to conceal a junction between the case and the cylindrical member from the fixed contact and the movable contact. The arc protection member further includes a bottom interposed between the movable contact and the closure plate. The drive unit includes a contact pressure provision member configured to bias the movable contact such that the movable contact comes into contact with the fixed contact. The contact pressure provision member is interposed between the movable contact and the bottom of the arc protection member so as to come into resilient contact with both the movable contact and the bottom of the arc protection member irrespective of a position of the movable contact.

According to the present invention, the arc protection member is pressed against the closure plate by use of the contact pressure provision member which is provided to bring the movable contact into contact with the fixed contact. Therefore, the arc protection member is held by the contact pressure provision member. Thus, in contrast to the prior art, the present invention does not require the pressing spring for holding the arc protection member. As a result, it is possible to reduce the number of parts necessitated for holding the arc protection member and to reduce the production cost.

In a preferred embodiment, the drive unit includes a shaft and an actuator. The shaft is disposed so as to penetrate through the movable contact, the bottom of the arc protection member, and the closure plate. The shaft is provided at its first end inside the sealed receptacle with a latch coming into contact with a fixed contact side surface of the movable contact. The shaft has its second end outside the sealed receptacle coupled to the actuator. The actuator is configured to move the shaft along its axial direction between a position where the latch separates the movable contact from the fixed contact and a position where the latch allows the movable contact to come into contact with the fixed contact. The sealed receptacle is configured to house a dust prevention member configured to cover a clearance between the shaft and a periphery of a through hole for the shaft formed in the bottom of the arc protection member. The dust prevention member includes a flange interposed between the contact pressure provision member and the bottom of the arc protection member.

In this preferred embodiment, it is possible to prevent dust from passing through the through hole of the arc protection member. Further, the dust prevention member is held by the contact pressure provision member. Therefore, it is unnecessary to add special parts for holding the dust prevention member. For example, the aforementioned dust is dissipation particles generated by contact of the movable contact with the fixed contact or by separation of the movable contact from the fixed contact.

In a preferred embodiment, any one of the closure plate and the bottom of the arc protection member includes a protrusion for positioning with the other including a recess for positioning configured to receive the positioning protrusion.

In this preferred embodiment, the arc protection member can be easily assembled into the contact device.

In a preferred embodiment, the drive unit includes a shaft, and an actuator including a fixed core penetrating through the closure plate, a movable core, and an electromagnet device. The shaft is disposed to penetrate through the movable contact, the bottom of the arc protection member, and the fixed core. The shaft is provided at its first end inside the sealed receptacle with a latch coming into contact with a fixed contact side surface of the movable contact. The shaft has its second end outside the sealed receptacle secured to the movable core. The electromagnet device is configured to generate a magnetic attraction between the fixed core and the movable core. The actuator is configured to control the electromagnet device to move the shaft along its axial direction between a position where the latch separates the movable contact from the fixed contact and a position where the latch allows the movable contact to come into contact with the fixed contact. The contact device includes a cap configured to fix the fixed core to the closure plate. The cap is secured to a surface of the closure plate opposed to the bottom of the arc protection member. Any one of the cap and the bottom of the arc protection member includes a protrusion for positioning with the other including a recess for positioning configured to receive the positioning protrusion.

In this preferred embodiment, the arc protection member can be easily assembled into the contact device.

In a more preferred embodiment, the contact device includes a plurality of the protrusions for positioning and a plurality of the recesses for positioning respectively corresponding to the plurality of the protrusions for positioning.

In this preferred embodiment, the arc protection member can be positioned while being prevented from rotating. Therefore, the arc protection member can be mounted yet without requiring adjusting a deviation caused by a rotation of the arc protection member. Thus, the contact device can be easily assembled. In addition, it is possible to reduce the production cost.

In a preferred embodiment, the drive unit includes a shaft, and an actuator including a fixed core penetrating through the closure plate, a movable core, and an electromagnet device. The shaft is disposed to penetrate through the movable contact, the bottom of the arc protection member, and the fixed core. The shaft is provided at its first end inside the sealed receptacle with a latch coming into contact with a fixed contact side surface of the movable contact. The shaft has its second end outside the sealed receptacle secured to the movable core. The electromagnet device is configured to generate a magnetic attraction between the fixed core and the movable core. The actuator is configured to control the electromagnet device to move the shaft along its axial direction between a position where the latch separates the movable contact from the fixed contact and a position where the latch allows the movable contact to come into contact with the fixed contact. The contact device includes a cap configured to fix the fixed core to the closure plate, the cap being secured to a surface of the closure plate opposed to the bottom of the arc protection member. The closure plate is provided with a first protrusion for positioning. The cap is provided with a second protrusion for positioning. The arc protection member is provided in its bottom with a first recess for positioning configured to receive the first protrusion and a second recess for positioning configured to receive a second protrusion.

In this situation, it is possible to position the arc protection member without rotating. Therefore, the arc protection member can be mounted yet without requiring adjusting a deviation caused by a rotation of the arc protection member. Thus, the contact device can be easily assembled. In addition, it is possible to reduce the production cost.

In a preferred embodiment, the bottom of the arc protection unit has a positioning portion configured to surround the contact pressure provision member.

In this preferred embodiment, the contact pressure provision member can be easily attached to the arc protection member.

In a more preferred embodiment, the positioning portion has its inner surface inclined such that a distance between the inner surface and the contact pressure provision member increases as a distance from the bottom increases.

In this preferred embodiment, the inner surface of the positioning portion guides the contact pressure provision member to an inside of the positioning portion. Therefore, the contact pressure provision member can be more easily attached to the arc protection member.

In a preferred embodiment, the contact pressure provision member is a coil spring. The arc protection member is provided on its bottom with a positioning portion configured to intrude into the contact pressure provision member.

In this preferred embodiment, the contact pressure provision member can be easily attached to the arc protection member.

In a more preferred embodiment, the positioning portion has its outer surface inclined such that a distance between the outer surface and the contact pressure provision member increases as a distance from the bottom increases.

In this preferred embodiment, the outer surface of the positioning portion guides the contact pressure provision member to the inside of the positioning portion. Therefore, the contact pressure provision member can be more easily attached to the arc protection member.

BEST MODE FOR CARRYING OUT THE INVENTION

The contact device 10 of an embodiment in accordance with the present invention is so-called a sealed contact device (or so-called a silent contact device). As shown in FIGS. 2A and 2B, the contact device 10 includes a contacts mechanism unit 11, an extinguishing unit 12, and a housing 13 configured to house the contacts mechanism unit 11 and the extinguishing unit 12. In a following explanation, an upward direction in FIG. 1 denotes a forward direction of the contact device 10, and a downward direction in FIG. 1 denotes a rearward direction of the contact device 10, and a left direction in FIG. 1 denotes a left direction of the contact device 10, and a right direction in FIG. 1 denotes a right direction of the contact device 10. In addition, an upward direction in FIG. 2A denotes an upward direction of the contact device 10, and a downward direction in FIG. 2A denotes a downward direction of the contact device 10.

Figure 1:
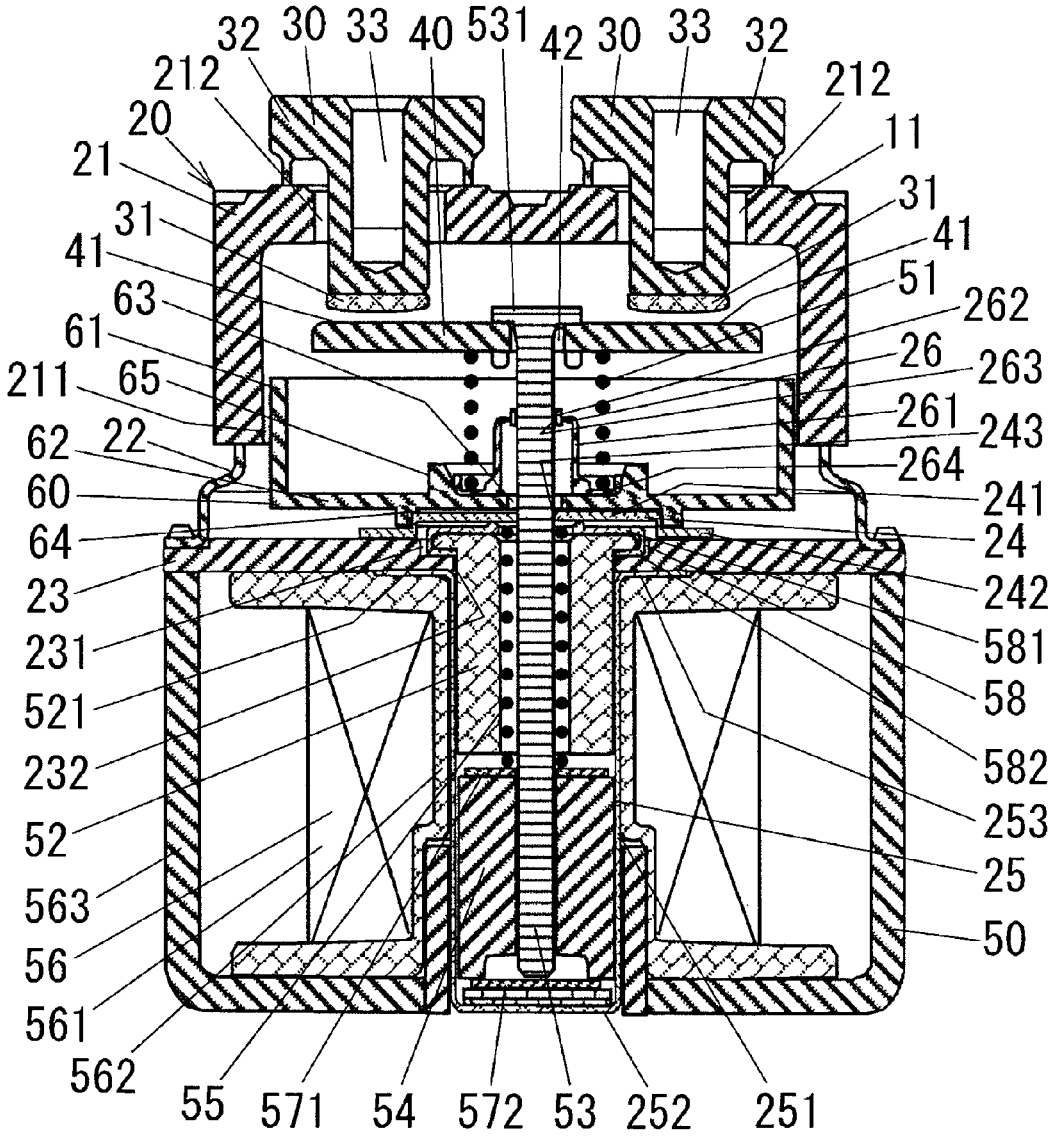
FIG. 1 is a cross sectional view illustrating a primary part of a contact device of a first embodiment in accordance with the present invention.
Figure 2A:
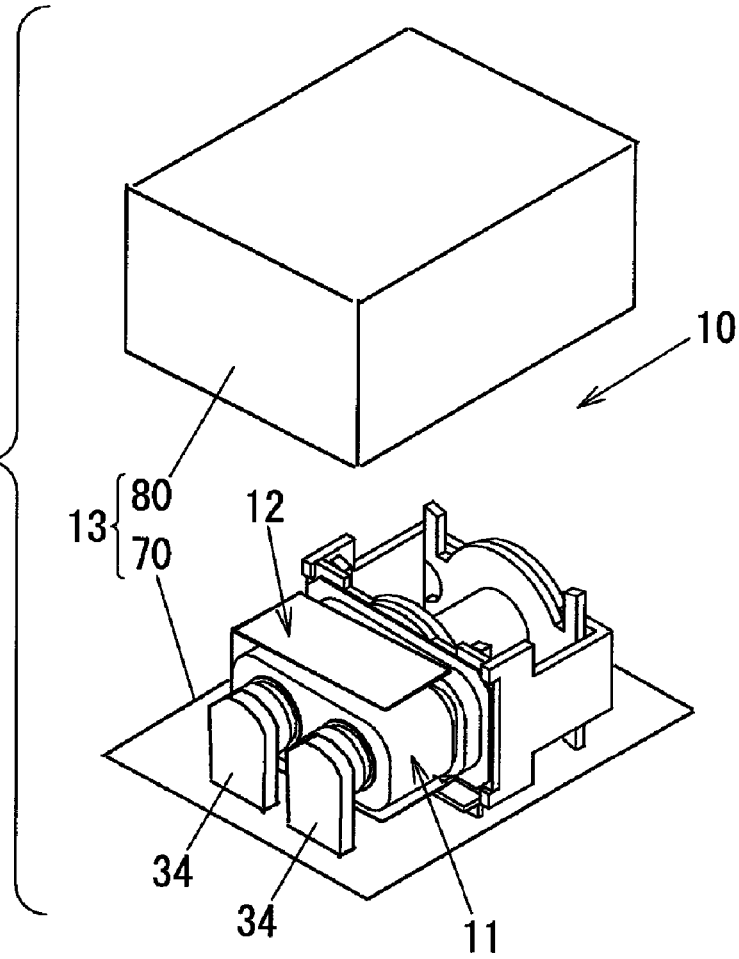
FIG. 2A is an exploded perspective view illustrating the above contact device.
Figure 2B:
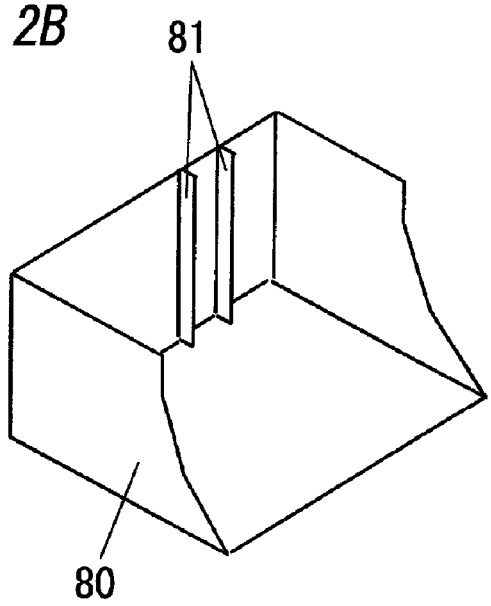
FIG. 2B is a perspective view illustrating a cover of the above contact device.

As shown in FIG. 1, the contacts mechanism unit 11 includes a sealed receptacle 20 configured to house a fixed contact 31, a movable contact 40, and an arc protection member 60, and a drive unit 50.

The drive unit 50 is configured to move the movable contact 40 between an on-position and an off-position. The on-position is defined as a position where the movable contact 40 is kept in contact with the fixed contact 31. The off-position is defined as a position where the movable contact 40 is kept away from the fixed contact 31. The aforementioned drive unit 50 includes a contact pressure provision spring (contact pressure provision member) 51, a fixed core 52, a shaft 53, a movable core 54, a return spring 55, and an electromagnet device 56. In this drive unit 50, the fixed core 52, the movable core 54, and the electromagnet device 56 constitute an actuator configured to move the shaft 53 along its axial direction.

The sealed receptacle 20 includes a case (contact case) 21 made of dielectric materials, a cylindrical member 22 made of metals, and a closure plate 23.

The case 21 is provided with an aperture 211 in its rear wall (first wall). The case 21 is provided with two through holes 212 for fixed terminals 30 in a right portion and left portion of its front wall (second wall opposed to the first wall). The dielectric material of the case 21 is preferred to be a ceramic having heat resistance.

The cylindrical member 22 is defined as a junction member for connecting the closure plate 23 to the case 21. The cylindrical member 22 is shaped into a cylindrical shape. An axial center portion of the cylindrical member 22 is wholly bent to narrow its front aperture relative to its rear aperture.

The closure plate 23 is made of magnetic metals (e.g. irons) and is shaped to have a rectangular shape. The closure plate 23 has enough dimensions to cover the rear aperture of the cylindrical member 22. The closure plate 23 is provided with a recess 231 in a center of its front surface. A through hole 232 for the fixed core 52 is formed in a center of a bottom of the recess 231. Further, a cap 24 and a core case 25 are fixed to the closure plate 23.

In respect to the sealed receptacle 20, the cylindrical member 22 has its front end (first axial end) secured in an airtight manner to a periphery of the aperture 211 of the rear wall of the case 21. The cylindrical member 22 further has its rear end (second axial end) secured in an airtight manner to the closure plate 23. An extinguishing gas (e.g. hydrogen gas) is sealed in the sealed receptacle 20.

The fixed terminals 30 are secured to the front wall of the sealed receptacle 20. The fixed terminal 30 is made of metals (e.g. a copper material) and is shaped into a circular cylindrical shape. The fixed contact 31 is secured to a rear end (first end) of the fixed terminal 30. The fixed contact 31 is attached to the front wall of the sealed receptacle 20 through the fixed terminal 30. The fixed terminal 30 is provided with a flange 32 at its front end (second end) and is provided with a screw hole 33 in its front end. In the present embodiment, the fixed terminal 30 and the fixed contact 31 are provided as separate parts. However, a part of the fixed terminal 30 may be defined as the fixed contact 31.

The front end of the fixed terminal 30 extends out through the through hole 211 from the sealed receptacle 20. In other words, the fixed terminal 30 is attached to the sealed receptacle 20 to place its rear end inside the sealed receptacle 20 and to place its front end outside the sealed receptacle 20. In this situation, the flange 32 of the fixed terminal 30 is fixed in an airtight manner to the front wall of the case 21, by use of a brazing method or the like. The screw hole 33 of the fixed terminal 30 is used for fixing an external connection terminal 34 (see FIG. 2) to the fixed terminal 30 by use of a screw. The external connection terminal 34 is used for connection of the fixed contact 31 and an external circuit (e.g. an electrical circuit of a mounted board on which the contact device 10 is mounted).

The movable contact 40 is made of metals (e.g. a copper material) and is shaped into a rectangular plate shape. The movable contact 40 has enough dimensions to come into contact with both the right and left fixed contacts 31. In the present embodiment, right and left portions of the movable contact 40 are respectively defined as a contact portion 41 for the fixed contact 31. The movable contact 40 further has a through hole 42 for a shaft. The through hole 42 penetrates through a center of the movable contact 40 along a thickness direction of the movable contact 40. In the present embodiment, a part of the movable contact 40 is used as the contact portion 41. However, the contact portion 41 may be provided as a separate part from the movable contact 40.

Figure 3A:
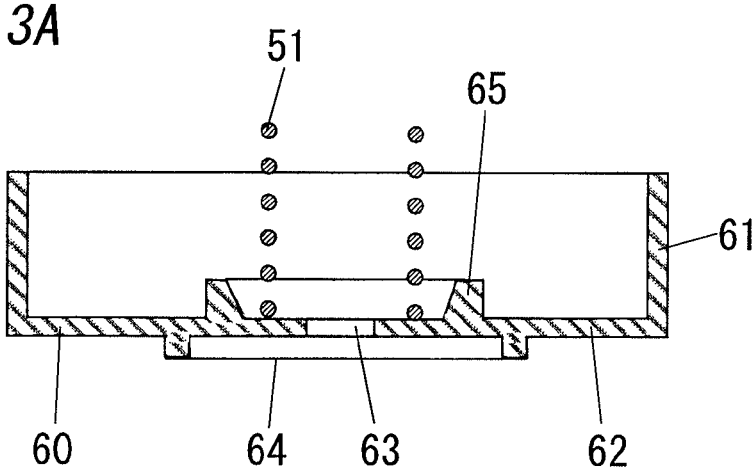
FIG. 3A is a cross sectional view illustrating an arc protection member of the above contact device.
Figure 3B:
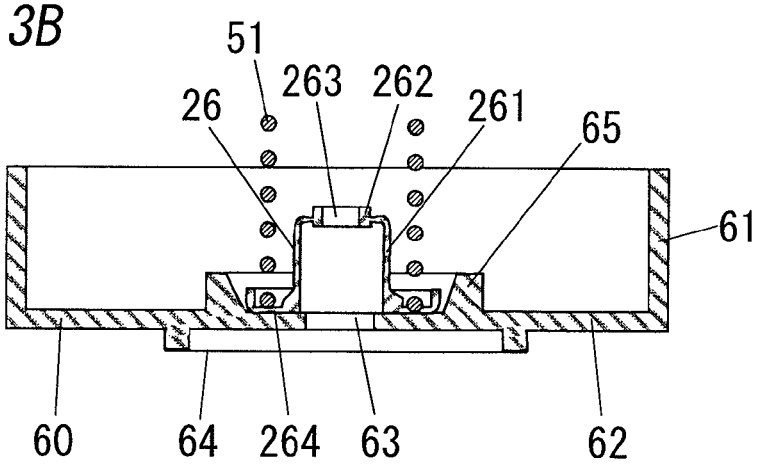
FIG. 3B is a cross sectional view illustrating the arc protection member of the above contact device.

As shown in FIGS. 3A and 3B, the arc protection member 60 includes a cylindrical peripheral wall 61 and a bottom 62. The peripheral wall 61 is configured to conceal a junction between the case 21 and the cylindrical member 22 from the fixed contacts 31 and the movable contact 40. The bottom 62 is configured to cover a rear aperture of the peripheral wall 61. The bottom 62 is interposed between the movable contact 40 and the closure plate 23. The bottom 62 is provided in its center with a through hole 63 for a shaft 53.

The contact pressure provision spring (hereinafter abbreviated as "spring") 51 is a coil spring. The spring 51 is interposed between the bottom 62 of the arc protection member 60 and the movable contact 40. The spring 51 has its natural length to be always compressed irrespective of a position of the movable contact 40. That is, the spring 51 is interposed between the movable contact 40 and the bottom 62 of the arc protection member 60 so as to come into resilient contact with both the movable contact 40 and the bottom 62 of the arc protection member 60 irrespective of a position of the movable contact 40. The spring 51 is not limited to a coil spring and may be a plate spring. An elastic member (e.g. a rubber) can be adopted as the contact pressure provision member instead of the spring 51.

Figure 4:
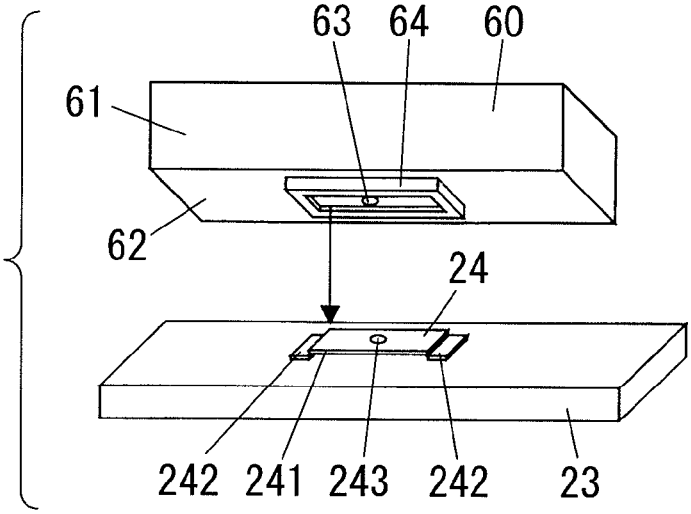
FIG. 4 is an explanatory view illustrating the arc protection member and a closure plate of the above contact device.

By the way, as shown in FIG. 4, the bottom 62 is provided with a recess 64 for positioning in its rear surface (surface of the bottom 62 opposed to the closure plate 23). The recess 64 is formed in the rear surface of the bottom 62 so as to receive a nipper portion 241 of an after-mentioned cap 24 when the arc protection member 60 is placed in a predetermined position relative to the closure plate 23.

Meanwhile, the bottom 62 is provided in its front surface (surface of the bottom 62 opposed to the movable contact 40) with a positioning portion 65 for the spring 51. The positioning portion 65 is shaped into a circular cylindrical shape to surround a rear end (end of the spring 51 which comes into contact with the bottom 62) of the spring 51. The positioning portion 65 further has its inner surface inclined such that a distance between the inner surface and the spring 51 increases as a distance from the bottom 62 increases (the distance between the inner surface and the spring 51 is made greater towards a front end of the positioning portion 65 than at a rear end of the positioning portion 65). In other words, the positioning portion 65 has a tapered shape to guide the rear end of the spring 51 to an inside of the positioning portion 65. The positioning portion 65 is not always required to have a cylindrical shape. The positioning portion 65 may be defined by a plurality of protrusions arranged to surround the rear end of the spring 51.

Figure 5:
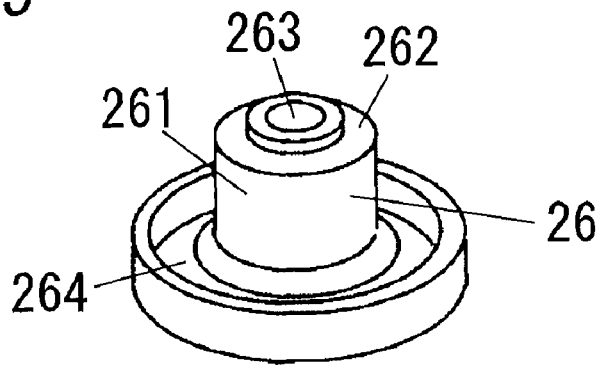
FIG. 5 is a perspective view illustrating a dust prevention member of the above contact device.

A dust prevention member 26 is located inside the positioning portion 65. The dust prevention member 26 is configured to cover a clearance between the shaft 53 and a periphery of the through hole 63 of the arc protection member 60. The dust prevention member 26 is made of an elastic material (e.g. an elastomer such as a silicone rubber). As shown in FIG. 5, the dust prevention member 26 has a cylindrical portion 261 shaped into a circular cylindrical shape. The cylindrical portion 261 has its inner diameter greater than an inner diameter of the through hole 63. The dust prevention member 26 has a front wall portion 262 covering a front aperture of the cylindrical portion 261. The front wall portion 262 is provided in its center with a hole 263. The hole 263 has its inner diameter slightly smaller than an outer diameter of the shaft 53. Consequently, an inner periphery of the hole 263 comes into close contact with an outer periphery of the shaft 53. The front wall portion 262 is formed to have its peripheral portion of the hole 263 thicker than its outer edge portion. Accordingly, it is possible to improve contact of the inner periphery of the hole 263 and the outer periphery of the shaft 53. The dust prevention member 26 further has a flange portion 264. The flange portion 264 extends out from the rear end of the cylindrical portion 261. As shown in FIG. 3B, the flange portion 264 is interposed between the rear end of the spring 51 and the bottom 62. That is, the flange portion 264 of the dust prevention member 26 is held by the spring 51 and the bottom 62 between the spring 51 and the bottom 62. Thereby, the dust prevention member 26 is fixed to the arc protection member 60.

The fixed core 52 is made of a magnetic material and is shaped into a cylindrical shape (e.g. a circular cylindrical shape). The fixed core 52 is provided at its front end with a flange 521 configured to be hooked over a periphery of the through hole 232 of the closure plate 23.

The aforementioned cap 24 is used for fixing the fixed core 52 to the closure plate 23. The cap 24 includes the nipper portion 241 being in the form of a rectangular plate shape and configured to hold the flange 521 of the fixed core 52 in association with the closure plate 23. The nipper portion 241 is defined as a protrusion for positioning corresponding to the recess 64 of the arc protection member 60. Fixing portions 242 are provided to right and left ends of a rear surface of the nipper portion 241, respectively. The cap 24 is fixed to the closure plate 23 by bonding rear surfaces of the fixing portions 242 to the front surface of the closure plate 23. The nipper portion 241 is further provided with a through hole 243 for the shaft 53. The through hole 243 has its inner diameter smaller than an inner diameter of the fixed core 52.

Figure 6A:
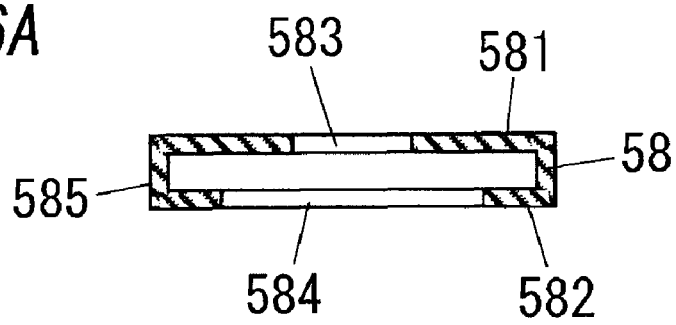
FIG. 6A is a cross sectional view illustrating a shock absorber of the above contact device.
Figure 6B:
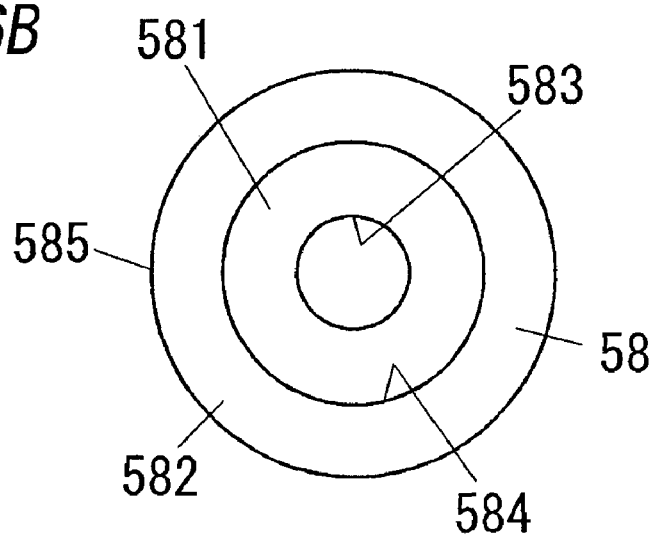
FIG. 6B is a bottom view illustrating the shock absorber of the above contact device.

The front end of the fixed core 52 is covered with a shock absorber 58. The shock absorber 58 is made of an elastic material (e.g. an elastomer such as a silicone rubber). As shown in FIGS. 6A and 6B, the shock absorber 58 includes a first resilient portion 581 and a second resilient portion 582. The first resilient portion 581 is interposed between the flange 521 of the fixed core 52 and the nipper portion 241 of the cap 24. The second resilient portion 582 is interposed between the flange 521 of the fixed core 52 and the closure plate 23. Both the first resilient portion 581 and the second resilient portion 582 are in the form of a circular disk shape. The first resilient portion 581 is provided in its center with a through hole 583 for the shaft 53. The second resilient portion 582 is provided in its center with a through hole 584 for the fixed core 52.

Additionally, the shock absorber 58 includes a connection portion 585 configured to integrally connect an outer edge of the first resilient portion 581 to an outer edge of the second resilient portion 582. It is noted that a distance between a rear surface of the first resilient portion 581 and a front surface of the second resilient portion 582 is identical to a thickness of the flange 521 of the fixed core 52.

Figure 7A:
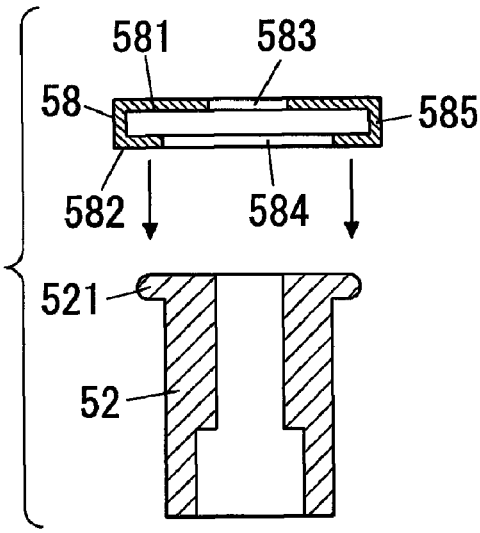
FIG. 7A is an explanatory view illustrating a method of attaching the shock absorber to a fixed core of the above contact device.
Figure 7B:
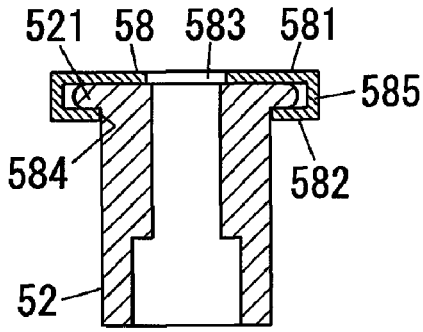
FIG. 7B is an explanatory view illustrating the method of attaching the shock absorber to the fixed core of the above contact device.

The shock absorber 58 is attached to the fixed core 52 as follows. As shown in FIGS. 7A and 7B, the flange 521 of the fixed core 52 is inserted into the shock absorber 58 via the through hole 584. In order to attach the shock absorber 58 to the fixed core 52, the second resilient portion 582 is elastically deformed such that the inner diameter of the through hole 584 becomes greater than the outer diameter of the flange 521.

In the prior contact device, the shock absorber 58 includes the first resilient portion 581 and the second resilient portion 582. However, in the prior contact device, the first resilient portion 581 is separated from the second resilient portion 582. Therefore, in order to attach the shock absorber 58 to the fixed core 52, it is necessary to attach the first resilient portion 581 to the front surface side of the flange 521 and also to attach the second resilient portion 582 to the rear surface side of the flange 522. Additionally, it is difficult to manipulate the first resilient portion 581 and the second resilient portion 582 individually. Therefore, the shock absorber 58 can not be easily attached to the fixed core 52.

However, in the contact device 10 of the present embodiment, the shock absorber 58 includes the connection portion 585 configured to integrally connect the first resilient portion 581 to the second resilient portion 582. Therefore, it is unnecessary to attach individually the first resilient portion 581 and the second resilient portion 582 to the fixed core 52. In addition, it is easy to manipulate the shock absorber 58. Thus, the shock absorber 58 can be easily attached to the fixed core 52.

The core case 25 is configured to house the fixed core 52 in its front end side and the movable core 54 in its rear end side. The core case 25 includes a side wall portion 251 shaped into a circular cylindrical shape. The side wall portion 251 has its inner diameter approximately identical to the inner diameter of the through hole 232 of the closure plate 23. In addition, the core case 25 includes a bottom wall portion 252 configured to cover a rear aperture of the side wall portion 251. Further, the core case 25 includes a flange portion 253 shaped into a circular shape and formed at a front end side of the side wall portion 251. The core case 25 is attached to the closure plate 23 by bonding in an airtight manner a front surface of the flange portion 253 to a rear surface of the closure plate 23. It is noted that a center of the side wall portion 251 of the core case 25 is aligned with a center of the through hole 232 of the closure plate 23.

The shaft 53 is shaped into a round bar shape. The shaft 53 is inserted into the through hole 42 of the movable contact 40, the through hole 63 of the arc protection member 60, and an inside of the fixed core 52. That is, the shaft 53 is disposed so as to penetrate through the movable contact 40, the arc protection member 60, and the fixed core 52. The shaft 53 has its front end (first end) placed inside the sealed receptacle 20 and its rear end (second end) placed outside the sealed receptacle 20.

The shaft 53 is provided at its front end with a latch 531 being in the form of a circular disk shape. The latch 531 has its outer diameter greater than the inner diameter of the through hole 42 of the movable contact 40. Therefore, the latch 531 comes into contact with the front surface (fixed contact 31 side surface of the movable contact 40) of the movable contact 40. Therefore, the movable contact 40 moves rearward together with the shaft 53 when the shaft 53 moves rearward. The latch 541 locks the movable contact 40 in order to prevent the movable contact 40 from moving toward the fixed contact 31 by a spring force of the spring 51.

The movable core 54 is made of a magnetic material and is shaped into a circular cylindrical shape. The movable core 54 has a hole 541 which penetrates through the movable core 54 along an axial direction of the movable core 54. The rear end of the shaft 53 is inserted into the hole 541. Thereby, the movable core 54 is coupled to the rear end of the shaft 53. The movable core 54 is housed between a rear end surface of the fixed core 52 and the bottom wall portion 252 of the core case 25. A distance between the rear end surface of the fixed core 52 and the bottom wall portion of the core case 25 is selected in consideration of a distance (contact gap) between the fixed contact 31 and the contact portion 41.

A buffer member 571 is interposed between the movable core 54 and the fixed core 52. The buffer member 571 is configured to absorb impact caused when the movable core 54 comes into contact with the fixed core 52. Likewise, a buffer member 572 is interposed between the movable core 54 and the core case 25. The buffer member 572 is configured to absorb impact caused when the movable core 54 comes into contact with the bottom wall portion 252. The buffer members 571 and 572 are made of an elastic material (e.g. an elastomer such as a rubber) and are shaped into a circular annular shape.

The return spring (hereinafter abbreviated as "spring") 55 is a coil spring. The spring 55 is interposed between the cap 24 and the movable core 54. The spring 55 is greater in a spring constant than the spring 51. Therefore, the spring 55 keeps the movable core 54 away from the fixed core 52. In other words, the spring 55 presses the movable core 54 against the bottom wall portion 252. In this situation, the shaft 53 keeps the movable contact 40 away from the fixed contacts 31. That is, the movable contact 40 is placed in the off-position.

Figure 11:
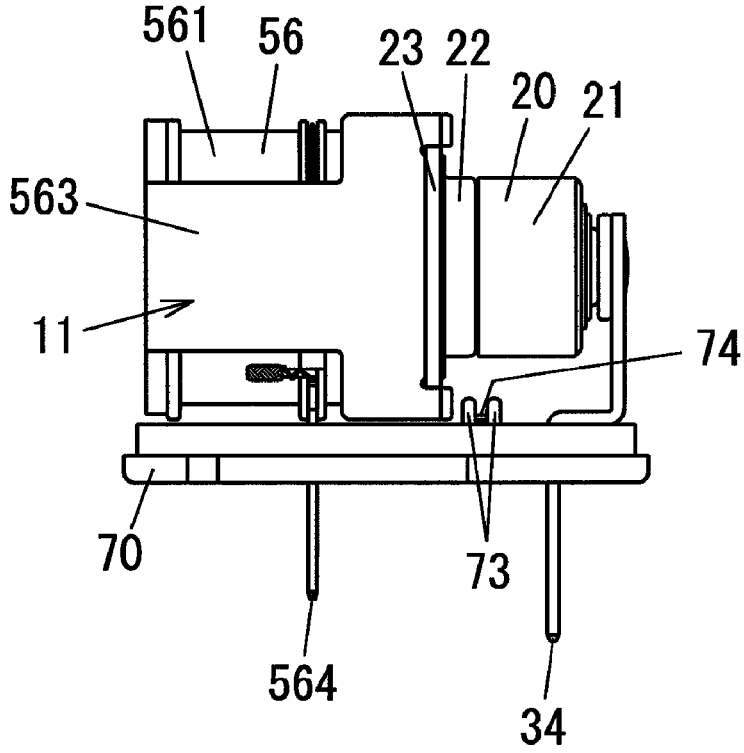
FIG. 11 is a right side view illustrating the base and a contacts mechanism unit of the above contact device.

The electric magnet device 56 includes a coil 561, a coil bobbin 562, and a yoke 563. The coil bobbin 562 is configured to carry the coil 561. The coil bobbin 562 is shaped into a circular cylindrical shape. The coil bobbin 562 has its inner diameter greater than an outer diameter of the side wall portion 251 of the core case 25. The yoke 563 is made of a magnetic material, and is shaped into an approximately U-shape in order to cover a rear side, a right side, and a left side of the coil bobbin 562. The electric magnet device 56 is attached to the rear surface side of the closure plate 23 while the core case 25 is inserted into the coil bobbin 562. In the contact device 10, the fixed core 52, the movable core 54, the yoke 563, and the closure plate 23 constitute a magnetic circuit. In addition, as shown in FIG. 11, the coil 561 has its opposite ends respectively electrically connected to coil terminals 564.

When the coil 561 is energized, a magnetic attraction is generated between the fixed core 52 and the movable core 54. Thereby, the movable core 54 is moved toward the fixed core 52 against the spring force of the spring 55. That is, the electromagnet device 56 is configured to generate the magnetic attraction between the fixed core 52 and the movable core 54, thereby moving the movable core 54 toward the fixed core 52. When the movable core 54 moves towards the fixed core 52, the shaft 53 also moves forward. As a result, the latch 531 moves forward past the fixed contacts 31. In this situation, the spring force of the spring 51 allows the movable contact 40 to come into contact with the fixed contacts 31 at the predetermined contact pressure.

In the contact device 10, the spring 55 keeps the movable contact 40 in the off-position while the coil 561 is not energized. Meanwhile, the electric magnet device 56 keeps the movable contact 40 in the on-position while the coil 561 is energized. The spring 51 is interposed between the movable contact 40 and the bottom 62 so as to come into resilient contact with both the movable contact 40 and the bottom 62 irrespective of a position of the movable contact 40.

Figure 25A:
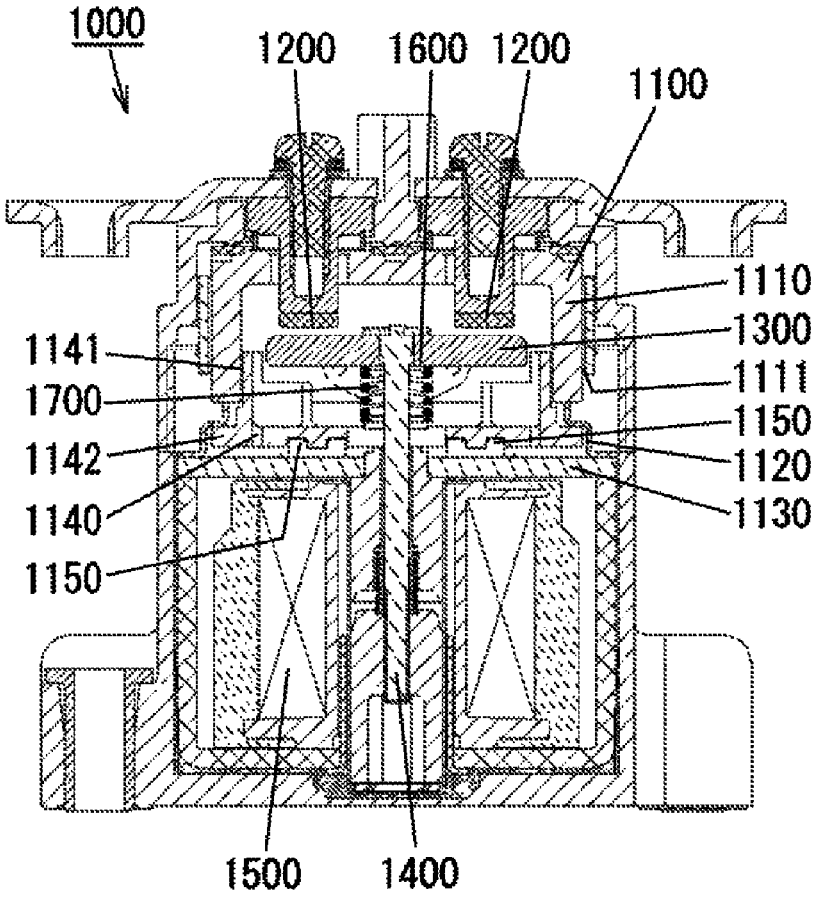
FIG. 25A PRIOR ART
FIG. 25A is a cross sectional view illustrating a prior contact device.
Figure 25B:
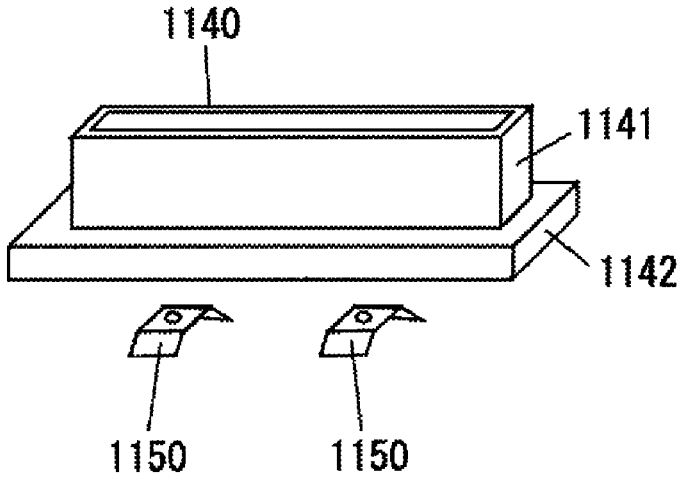
FIG. 25B PRIOR ART
FIG. 25B is a perspective view illustrating an arc protection member and pressing springs of the prior contact device.

Therefore, in the contact device 10 of the present embodiment, the spring 51 holds the arc protection member 60. In other words, the spring 51 which makes the movable contact 40 come into contact with the fixed contact is used as a holding member for the arc protection member 60. Thus, according to the contact device 10, the pressing springs 1150 shown in FIG. 25 are unnecessary. As a result, it is possible to reduce the number of parts necessitated for holding the arc protection member 60 and to reduce the production cost.

In addition, the nipper portion 241 of the cap 24 is fitted into the recess 63 of the arc protection member 60. Therefore, the arc protection member 60 is positioned relative to the closure plate 23. Thus, according to the contact device 10, the arc protection member 60 can be easily assembled into the contact device 10.

Further, as described in the above, the contact device 10 includes the dust prevention member 26. Therefore, according to the contact device 10, it is possible to prevent dust from intruding into the core case 57 through the through hole 63. Thus, the dust does not prevent the movable core 54 from moving forward/rearward. For example, the aforementioned dust is dissipation particles generated by contact of the movable contact 40 with the fixed contact 31 or by separation of the movable contact 40 from the fixed contact 31. Moreover, according to the contact device 10, the dust prevention member 26 is fixed to the arc protection member 60 by use of the spring 51. Therefore, it is unnecessary to add special parts for holding the dust prevention member.

Figure 8A:
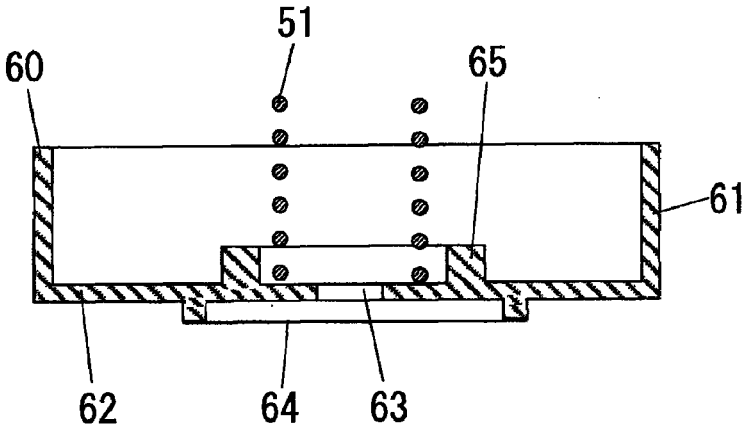
FIG. 8A is a cross sectional view illustrating a modification of the arc protection member of the contact device.
Figure 8B:
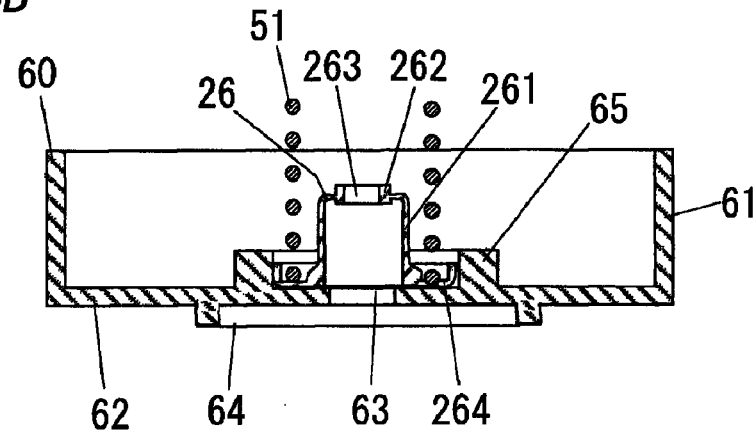
FIG. 8B is a cross sectional view illustrating the modification of the arc protection member of the contact device of FIG. 8A.

Additionally, the arc protection member 60 is provided on its bottom 62 with the positioning portion 65. Therefore, according to the contact device 10, the spring 51 can be easily attached to the arc protection member 60. Especially, the positioning portion 65 has its inner surface inclined such that the distance between the inner surface of the positioning portion 65 and the spring 51 increases as the distance from the bottom 62 increases. Therefore, the inner surface of the positioning portion 65 guides the rear end of the spring 51 to the inside of the positioning portion 65. Thus, the spring 51 can be more easily attached to the arc protection member 60. However, the positioning portion 65 does not need to have its inner surface inclined in an aforementioned manner. For example, as shown in FIGS. 8A and 8B, the inner surface of the positioning portion 65 may not be inclined.

Figure 9A:
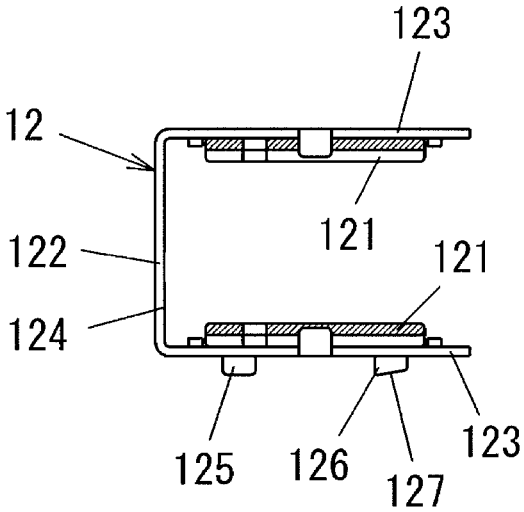
FIG. 9A is a front view illustrating an extinguishing unit of the above contact device.
Figure 9B:
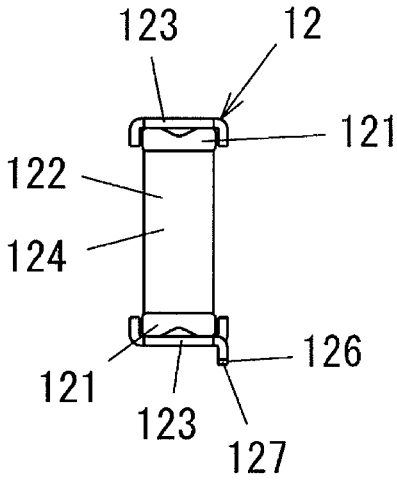
FIG. 9B is a left side view illustrating the extinguishing unit of the above contact device.

As described in the above, the contact device 10 of the present embodiment includes the extinguishing unit 12. As shown in FIGS. 9A and 9B, the extinguishing unit 12 includes a pair of permanent magnets 121 and a yoke 122. The yoke 122 is configured to carry the pair of the permanent magnets 121. The yoke 122 is made of a magnetic metal material (e.g. an iron) and is shaped into a U-shape. The yoke 122 includes a pair of side pieces 123 which extend across the upper and lower sides of the case 21 to hold the same therebetween. The yoke 122 further includes a connection piece configured to integrally connect first ends (right ends) of the side pieces 123 in the pair. As described in the above, the side pieces 123 in the pair are connected to each other at their first ends. Therefore, the sealed receptacle 20 can be mounted inside of the yoke 122 by a manipulation of sliding the yoke 122 from right to left of the sealed receptacle 20. The permanent magnets 121 are fixed to surfaces of the side pieces 123 opposed to the sealed receptacle 20, respectively. Therefore, the permanent magnets 121 in the pair are arranged on opposite sides of the sealed receptacle 20 with respect to a direction (upward/downward direction) crossing with (perpendicular to, in the illustrated instance) a direction (lateral direction in FIG. 2A) along which the movable contact 40 moves toward and away from the fixed contact 31. The extinguishing unit 12 generates a magnetic field along the upward/downward direction. Therefore, the extinguishing unit 12 can extends an arc developed between the fixed contact 31 and the contact portion 41, thereby extinguishing the same at a short time.

As shown in FIGS. 2A and 2B, the housing 13 includes a base 70 and a cover 80.

The cover 80 is shaped into a box shape having its rear surface opened. The cover 80 is attached to the base 70 to house the contacts mechanism unit 11 and the extinguishing unit 12 between the cover 80 and the base 70. As shown in FIG. 2B, the cover 80 is provided on its inner surface with a pair of holding pieces 81 configured to hold the connection piece 124 of the extinguishing unit 12 therebetween.

Figure 10A:
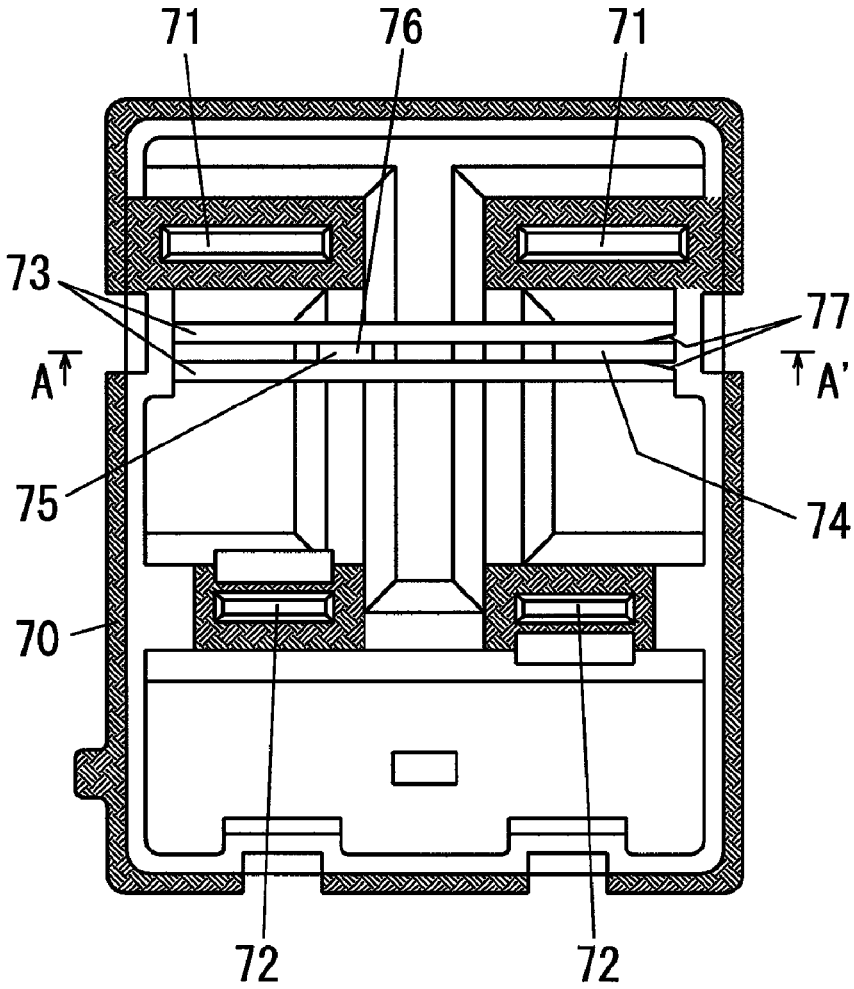
FIG. 10A is a top view illustrating a base of the above contact device.
Figure 10B:
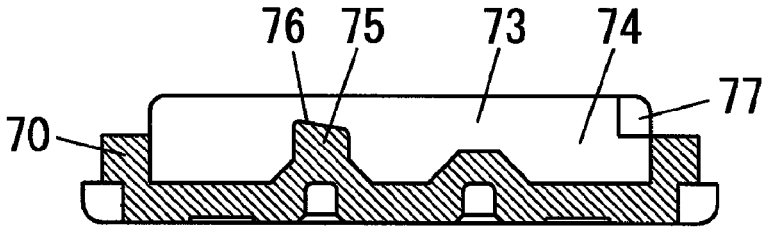
FIG. 10B is a cross sectional view of the base of the above contact device along the line A-A'.

The contacts mechanism unit 11 is mounted on the base 70. As shown in FIGS. 10A and 10B, the base 70 is shaped into a rectangular plate shape having enough dimensions to cover a rear surface side opening of the cover 80. The base 70 includes two insertion holes 71 for the external connection terminals 34. The respective insertion holes 71 penetrate through a front end portion of the base 70. The base 70 includes two insertion holes 72 for the coil terminals 564. The respective insertion holes 72 penetrate through a rear end portion of the base 70.

In addition, two click pieces 125 and 126 are formed on the lower side piece 123 of the yoke 122 (side piece 123 adjacent to the base 70). The respective click pieces 125 and 126 extend downward from the side piece 123. The respective click pieces 125 and 126 are shaped into a rectangular plate shape. Moreover, the click pieces 125 and 126 are arranged along a longitudinal direction (lateral direction) of the side piece 123 and are spaced from each other at a predetermined distance.

The base 70 is provided on its upper surface with a pair of wall portions 73 which are parallel to each other. The wall portion 73 has its longitudinal direction parallel to the lateral direction. A clearance between the wall portions 73 defines a groove 74. The groove 74 is defined as an attachment recess into which the respective click pieces 125 and 126 are inserted. When the click pieces 125 and 126 of the extinguishing unit 12 are inserted into the groove 74, the wall portions 73 hold the respective click pieces 125 and 126 therebetween in the forward/rearward direction. The groove 74 and the click pieces 125 and 126 constitute an attachment unit configured to attach the extinguishing unit 12 to the base 70. It is noted that the attachment unit may be constituted by an attachment protrusion provided to any one of the yoke 122 and the base 70 and an attachment recess provided to the other.

Herein, the groove 74 has its right end opened. Therefore, when the extinguishing unit 12 is attached to the base 70, the click pieces 125 and 126 can be inserted into the groove 74 from a lateral side (right side) instead of an upper side. In brief, the extinguishing unit 12 can be attached to the base 70 by sliding the extinguishing unit 12 from right to left of the base 70. Further, as described in the above, the sealed receptacle 20 can be mounted inside the yoke 122 by sliding the yoke 122 from right to left of the sealed receptacle 20. Accordingly, the extinguishing unit 12 can be attached to the base after the contacts mechanism unit 11 is mounted on the base 70, as shown in FIG. 11.

Additionally, a latching protrusion 75 for preventing detachment of the extinguishing unit 12 is formed on a bottom of the groove 74. The latching protrusion 75 is configured such that a left side surface of the latching protrusion 75 comes into contact with a right side surface of the click piece 126 when the extinguishing unit 12 is placed in a predetermined position relative to the base 70. In other words, the latching protrusion 75 locks the click piece 126 such that the extinguishing unit 12 is kept placed in the predetermined position. Therefore, the extinguishing unit 12 is not allowed to move towards a direction (direction where the extinguishing unit 12 is detached from the base 70) opposed to a direction where the extinguishing unit 12 is attached to the base 70 after being placed in the predetermined position.

Figure 12:
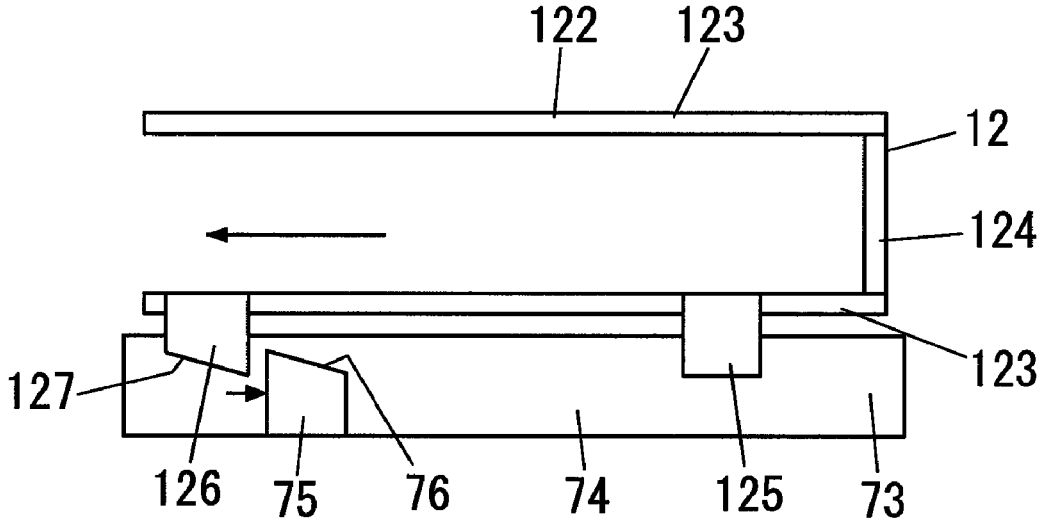
FIG. 12 is an explanatory view illustrating a method of attaching the extinguishing unit to the base of the above contact device.
Figure 13A:
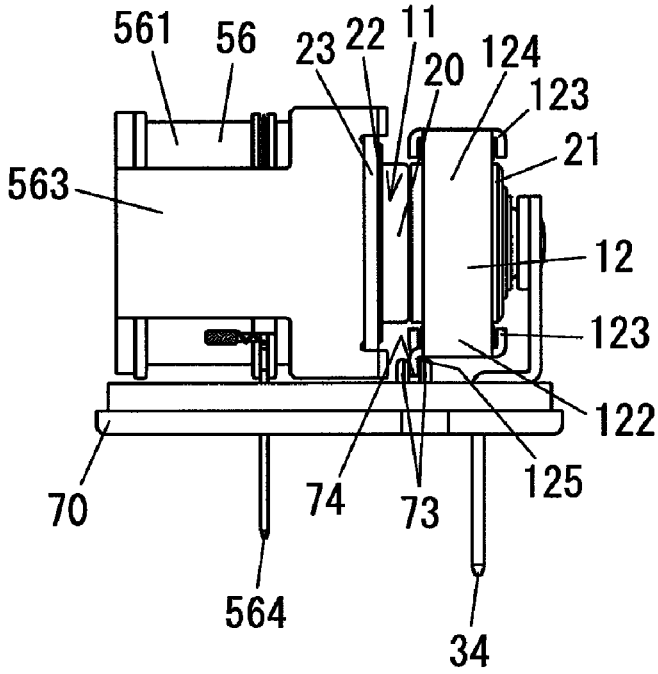
FIG. 13A is a right side view illustrating the above contact device without the cover.
Figure 13B:
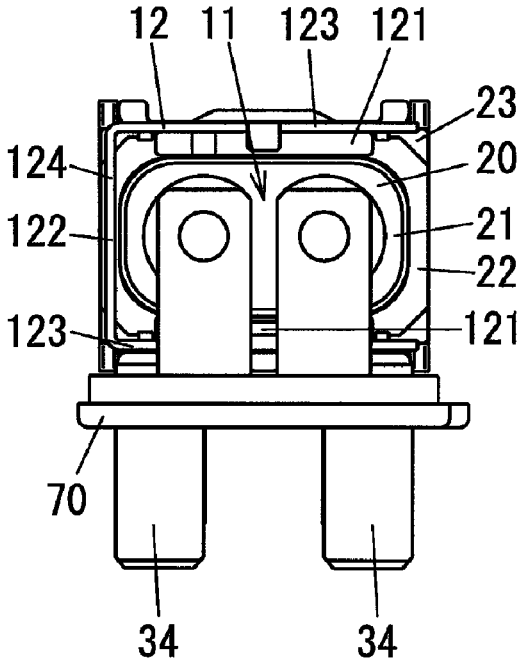
FIG. 13B is a front view illustrating the above contact device without the cover.

In the following, an explanation is made to a process of housing the contacts mechanism unit 11 and the extinguishing unit 12 in the housing 13. First, as shown in FIG. 11, the contacts mechanism unit 11 is mounted on the base 70. In this situation, the external connection terminals 34 and the coil terminals 564 are pressed into the insertion holes 71 and 72 of the base 70, respectively. Next, as shown in FIG. 12, the click pieces 125 and 126 are inserted into the groove 74 from one end side (right end side) of the base 70 by sliding the extinguishing unit 12 along a width direction of the base 70. Thereby, the extinguishing unit 12 is attached to the base 70. In this process, the click piece 126 rides over the latching protrusion 75 to be locked by the latching protrusion 75. Subsequently, after the contacts mechanism unit 11 and the extinguishing unit 12 are attached to the base 70 as shown in FIGS. 13A and 13B, the cover 80 is attached to the base 70 so as to cover the contacts mechanism unit 11 and the extinguishing unit 12.

By the way, the prior contact device is assembled by attaching the contacts mechanism unit to the base and subsequently attaching the cover to the base. In this situation, the extinguishing unit is not still attached to the base. Therefore, it is difficult to insert the connection piece of the yoke of the extinguishing unit between the holding pieces in the pair when attaching the cover to the base. Thus, the extinguishing unit can not be easily assembled into the housing.

By contrast, in the contact device 10 of the present embodiment, the extinguishing unit 12 can be attached to the base 70 by inserting the click pieces 125 and 126 into the groove 74 of the base 70. Therefore, the extinguishing unit 12 is positioned relative to the base 70 before the cover 80 is attached to the base 70. Thus, it is possible to easily inert the connection piece 124 of the extinguishing unit 12 between the holding pieces 81 of the pair of the cover 80. Consequently, the extinguishing unit 12 can be easily assembled into the housing 13. In the aforementioned instance, the yoke 122 is provided with the click pieces 125 and 126 as the attachment protrusions. Such the attachment protrusions may be provided to the base 70. With this arrangement, the groove 74 as the attachment recess is provided to the base 70, rather than the yoke 122. In other words, any one of the yoke 122 and the base 70 may include the attachment protrusion and the other may include the attachment recess configured to receive the attachment protrusion.

By the way, the latching protrusion 75 is provided at its front end with an inclined surface 76. The inclined surface 76 is inclined so as to lower its right end relative to its left end. In addition, the click piece 126 is provided at its front end with an inclined surface 127. The inclined surface 127 is inclined so as to raise its left end relative to its right end. The inclined surface 76 of the latching protrusion 75 and the inclined surface 127 of the click piece 126 are arranged to come into contact with each other when the extinguishing unit 12 is attached to the base 70 (the inclined surface 76 of the latching protrusion 75 and the inclined surface 127 of the click piece 126 are opposed to each other in a slide direction of the extinguishing unit 12). Therefore, the click piece 126 can easily ride over the latching protrusion 75 when the extinguishing unit 12 is slid to be attached to the base 70. Thus, the extinguishing unit 12 can be easily attached to the base 70.

As mentioned in the above, the latching protrusion 75 is provided with the inclined surface 76 at a portion which is opposed to the click piece 126 in the slide direction of the extinguishing unit 12. The inclined surface 76 guides the click piece 126 such that the click piece 126 rides over the latching protrusion 75. Therefore, the click piece 126 can easily ride over the latching protrusion 75 when the extinguishing unit 12 is attached to the base 70. Thus, the extinguishing unit 12 can be easily housed in the housing 13.

Moreover, the click piece 126 is provided with the inclined surface 127 at a portion which is opposed to the latching protrusion 75 in the slide direction of the extinguishing unit 12. The inclined surface 127 guides the latching protrusion 75 such that the click piece 126 rides over the latching protrusion 75. Therefore, the click piece 126 can easily ride over the latching protrusion 75 when the extinguishing unit 12 is attached to the base 70.

If the inclined surface 127 is provided to the click piece 126, it is unnecessary to provide the inclined surface 76 to the latching protrusion 75. Likewise, if the inclined surface 76 is provided to the latching protrusion 75, it is unnecessary to provide the inclined surface 127 to the click piece 126.

In addition, guide surfaces 77 are formed at right ends of both inner surfaces of the groove 74, respectively. The guide surface 77 is configured to guide the click piece 126 into the groove 74. The guide surface 77 is an inclined surface which is inclined such that a width of the groove 74 is made greater towards one end (right end) of the groove 74 than at the other end. The guide surface 77 allows the click piece 126 to be easily inserted into the groove 74. Therefore, according to the contact device 10, the extinguishing unit 12 can be easily housed in the housing 13.

Figure 14A:
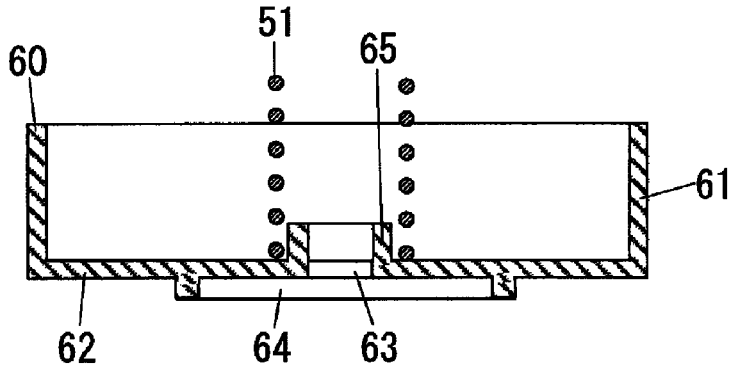
FIG. 14A is a cross sectional view illustrating a primary part of a modification of the above contact device.
Figure 14B:
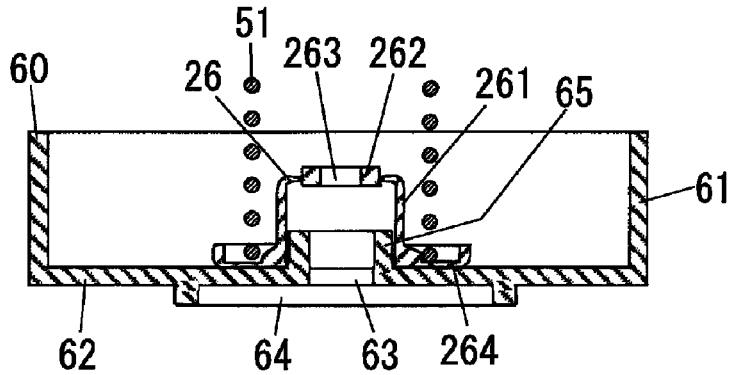
FIG. 14B is a cross sectional view illustrating the primary part of the modification of the above contact device of FIG. 14A.
Figure 14C:
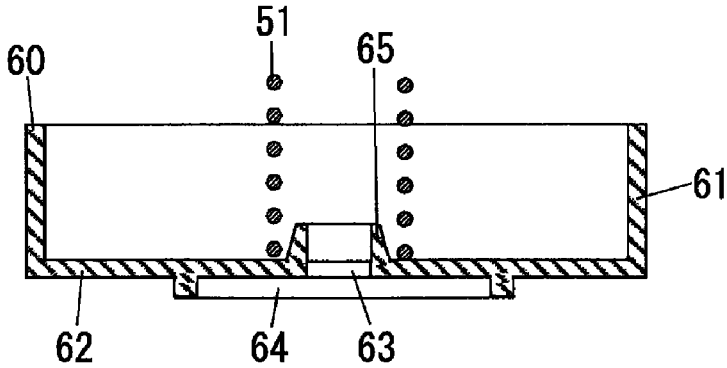
FIG. 14C is a cross sectional view illustrating a primary part of a modification of the above contact device.
Figure 14D:
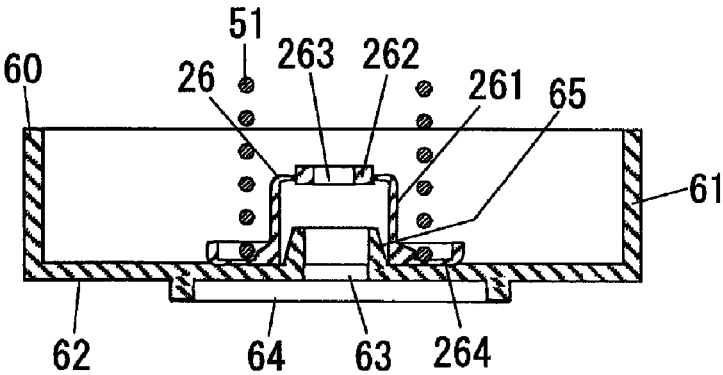
FIG. 14D is a cross sectional view illustrating the primary part of the modification of the above contact device of FIG. 140.

Respective FIGS. 14A and 14B show a modification of the contact device 10 of the present embodiment. In FIGS. 14A and 14B, the positioning portion 65 is shaped into a cylindrical shape (circular cylindrical shape, in the illustrated instance) having enough dimensions to be inserted into the inside of the spring 51. Also in this modification, the spring 51 can be easily attached to the arc protection member 60. In addition, as shown in FIGS. 14C and 14D, the positioning portion 65 is preferred to have its outer surface inclined such that a distance between the outer surface and the spring 51 increases as a distance from the bottom 62 of the arc protection member 60 increases. In other words, the positioning portion 65 is preferred to be shaped to have a tapered shape. In this situation, the outer surface of the positioning portion 65 guides the spring 51 to the inside of the positioning portion 65. Therefore, the spring 51 can be more easily attached to the arc protection member 60. The positioning portion 65 is not always required to have a cylindrical shape. The positioning portion 65 may be defined by a plurality of protrusions configured to be inserted into the inside of the spring 51.

Besides, in the contact device 10, the nipper portion 241 of the cap 24 is shaped into a rectangular shape. Therefore, according to the contact device 10, it is possible to position the arc protection member 60 without rotating. Meanwhile, in the prior contact device 1000, the peripheral wall 1141 of the arc protection member 1140 is only pressed against an inner surface of the contact case 1110. Therefore, according to the prior contact device 1000, it is necessary to house the arc protection member 1140 in the sealed receptacle 1100 while adjusting a deviation caused by rotation of the arc protection member 1140. According to the contact device 10 of the present embodiment, it is unnecessary to house the arc protection member 60 in the sealed receptacle 20 while adjusting a deviation caused by rotation of the arc protection member 60. Thus, the contact device 10 can be easily assembled. As a result, it is possible to reduce the production cost of the contact device 10.

Figure 15A:
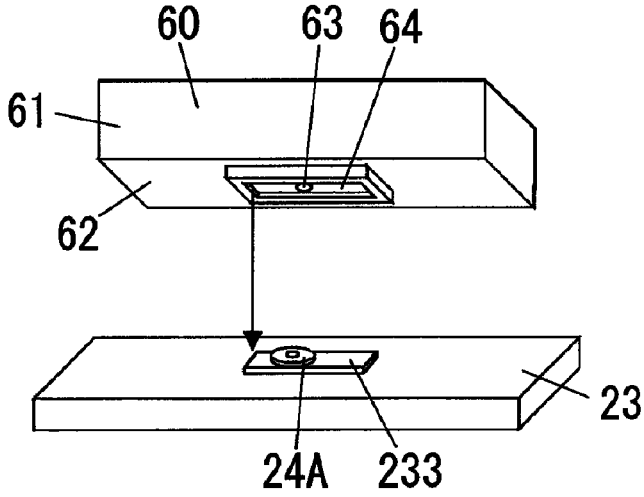
FIG. 15A is an explanatory view illustrating a modification of the above contact device.
Figure 15B:
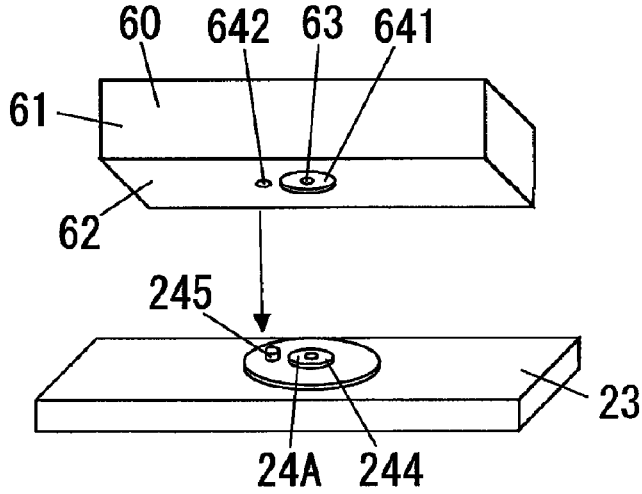
FIG. 15B is an explanatory view illustrating a modification of the above contact device.
Figure 15C:
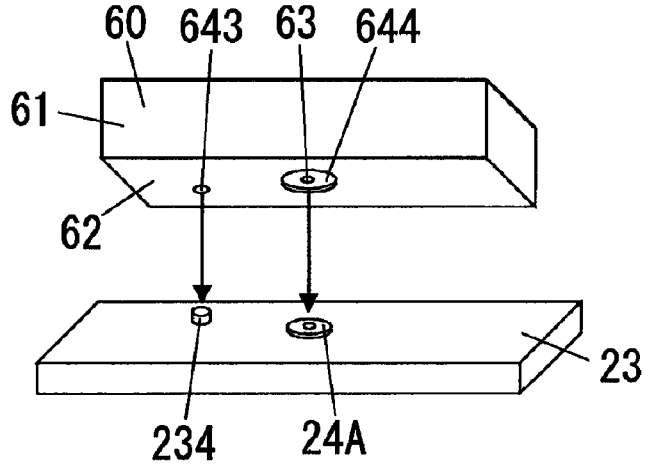
FIG. 15C is an explanatory view illustrating a modification of the above contact device.
Figure 16A:
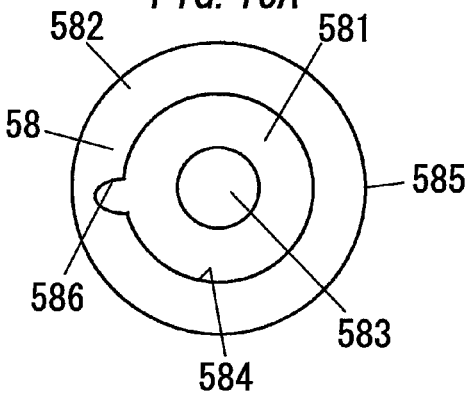
FIG. 16A is a rear view illustrating a modification of the shock absorber of the above contact device.
Figure 16C:
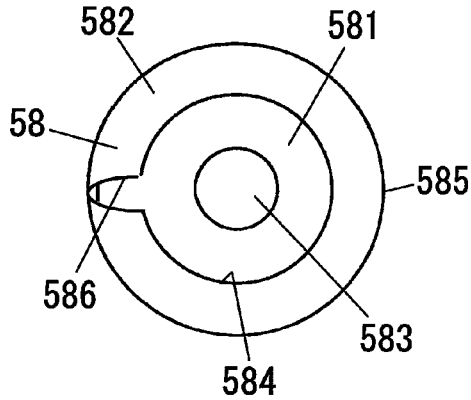
FIG. 16C is a rear view illustrating a modification of the shock absorber of the above contact device.
Figure 16B:
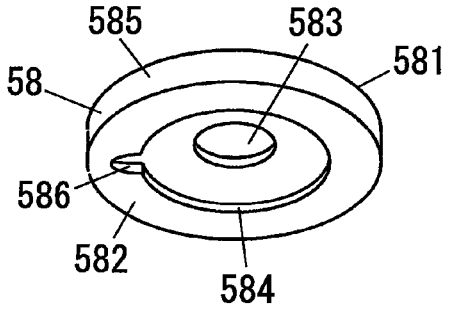
FIG. 16B is a perspective view illustrating the modification of the shock absorber of the above contact device of the FIG. 16A.
Figure 16D:
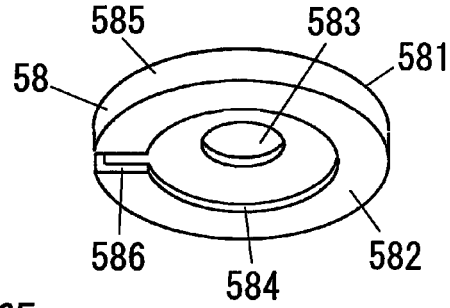
FIG. 16D is a perspective view illustrating the modification of the shock absorber of the above contact device of FIG. 16C.
Figure 16E:
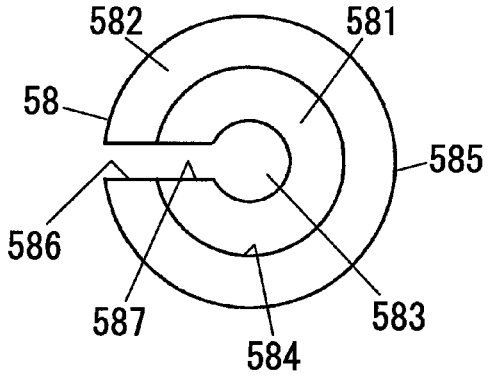
FIG. 16E is a rear view illustrating a modification of the shock absorber of the above contact device.
Figure 16F:
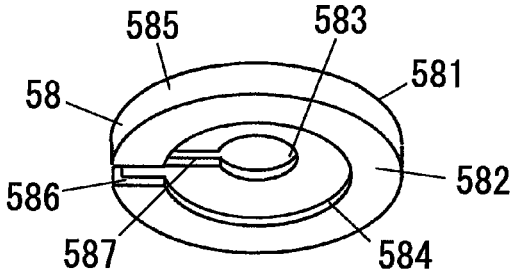
FIG. 16F is a perspective view illustrating the modification of the shock absorber of the above contact device of FIG. 16E.
Figure 17B:
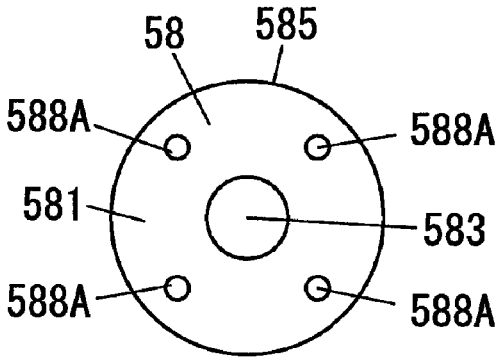
FIG. 17B is a front view illustrating the modification of the shock absorber of the above contact device of FIG. 17A.
Figure 17A:
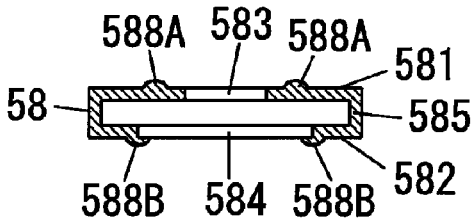
FIG. 17A is a cross sectional view illustrating a modification of the shock absorber of the above contact device.
Figure 17C:
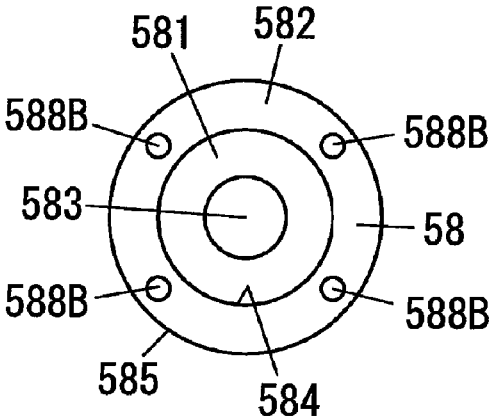
FIG. 17C is a rear view illustrating the modification of the shock absorber of the above contact device of FIG. 17A.
Figure 17D:
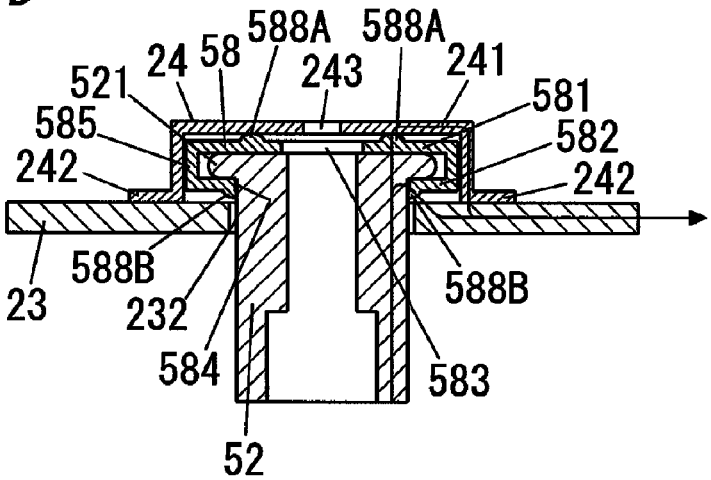
FIG. 17D is a cross sectional view illustrating a situation where the modification of the shock absorber of the above contact device of FIG. 17A is attached to the fixed core.

Respective FIGS. 15A to 15C show a modification of the contact device 10 of the present embodiment. In FIGS. 15A to 15C, the cap 24A is shaped into a circular disk shape.

In the modification shown in FIG. 15A, a protrusion 233 for positioning is formed on the front surface of the closure 23. The protrusion 233 is shaped to be fitted into the recess 64. The protrusion 233 is formed through a process of striking a center portion of the closure plate 23 to protrude it forwardly, for example. In the modification shown in FIG. 15A, the cap 24A is provided to a front surface of the protrusion 233. Also in this situation, the arc protection member 60 can be unrotatably positioned relative to the closure plate 23 by engagement of the protrusion 233 into the recess 64.

In the modification shown in FIG. 15B, two circular protrusions 244 and 245 for positioning extends from the front surface of the cap 24A. Meanwhile, two recesses 641 and 642 for positioning are formed in the rear surface of the bottom 62 of the arc protection member 60. The recesses 641 and 642 are corresponding to the protrusions 244 and 245, respectively. Therefore, in the modification shown in FIG. 15B, the arc protection member 60 is positioned relative to the closure plate 23 by engagement of the protrusion 244 and the recess 641 together with engagement of the protrusion 245 and the recess 642. Although each of the protrusions 244 and 245 has a circular shape, a plurality of the protrusions 244 and 245 can prevent rotation of the arc protection member 60. Besides, a plurality of the protrusions for positioning may be formed on the cap 24 instead of the closure plate 23.

In the modification shown in FIG. 15C, the closure plate 23 is provided on its front surface with a protrusion (first protrusion for positioning) 234 for positioning. The bottom 62 of the arc protection member 60 is provided in its rear surface with a recess (first recess for positioning recess) 643 for positioning configured to receive the protrusion 234. Additionally, in the modification shown in FIG. 15C, the cap 24A is defined as the second protrusion for positioning. The bottom 62 is provided in its rear surface with a recess (second recess for positioning) 644 for positioning configured to receive the cap 24A. Therefore, in the modification shown in FIG. 15C, the arc protection member 60 is positioned relative to the closure plate 23 by engagement of the protrusion 234 and the recess 643 together with engagement of the cap 24A and the recess 644. Although each of the cap 24A and the protrusion 234 has a circular shape, a plurality of the cap 24A and the protrusion 234 can prevent rotation of the arc protection member 60.

Moreover, in contrast to the aforementioned instance, the arc protection member 60 may include a protrusion for positioning, and the closure plate 23 or the cap 24 may include a recess for positioning into which the protrusion for positioning of the arc protection member 60 is fitted. The closure plate 23 may include plural protrusions for positioning or plural recesses for positioning.

Respective FIGS. 16 to 19 show a modification of the shock absorber 58. In the shock absorber 58 shown in FIGS. 16A and 16B, the second resilient portion 582 includes a cutout 586 communicating with the through hole 584. The cutout 586 is of a semielliptical shape having its width decreasing as an increase of a distance from the center of the second resilient portion 582. According to the shock absorber 58 shown in FIGS. 16A and 16B, the through hole 584 can easily expand due to resilient deformability given to the second resilient portion 582. Therefore, the shock absorber 58 can be more easily attached to the fixed core 52. In addition, a used amount of a material for the shock absorber 58 can be reduced by an amount of material corresponding to the cutout 586. Thus, the production cost can be reduced. Besides, a shape of the cutout 586 is not limited to the aforementioned instance. For example, as the shock absorber 58 shown in FIGS. 16C and 16D, the cutout 586 may extend to the outer edge of the second resilient portion 582. Alternately, as the shock absorber 58 shown in FIGS. 16E and 16F, the first resilient portion 581 also may be provided with a cutout 587 in a similar manner as the second resilient portion 582. With this arrangement, the cutout 587 of the first resilient portion 581 communicates with the cutout 586 of the second resilient portion 582.

In brief, it is sufficient that at least one of the first resilient portion 581 and the second resilient portion 582 is provided with a cutout communicating with the through holes 583 and 584 thereof.

In the shock absorber 58 shown in FIG. 17, the first resilient portion 581 is provided on its front surface with four protruded portions 588A. The protruded portions 588A are each shaped into a circular shape, and are arranged at regular intervals along a circumferential direction of the first resilient portion 581. In addition, the second resilient portion 582 is provided on its rear surface with four protruded portions 588B. The protruded portions 588B are each shaped into a circular shape, and are arranged at regular intervals along a circumferential direction of the first resilient portion 582. Besides, the number of the protruded portions 588A and the number of the protruded portions 588B are not limited to four. For example, the number of the protruded portions 588A and the number of the protruded portions 588B may be one to three, or more than four.

According to the shock absorber 58 shown in FIG. 17, the protruded portions 588A decrease a contact area of the first resilient portion 581 and the cap 24 relative to that of the shock absorber 58 shown in FIG. 16, and the protruded portions 588B decrease a contact area of the second resilient portion 582 and the closure plate 23 relative to that of the shock absorber 58 shown in FIG. 16. Therefore, a vibration caused by contact of the movable core 54 with the fixed core 52 is restrained from being transmitted to the cap 24 and the closure plate 23. Consequently, according to the contact device 10 having the shock absorber 58 shown in FIG. 17, it is possible to more reduce an operation noise of the contact device 10 by reducing the vibration transmitted outside.

Figure 18B:
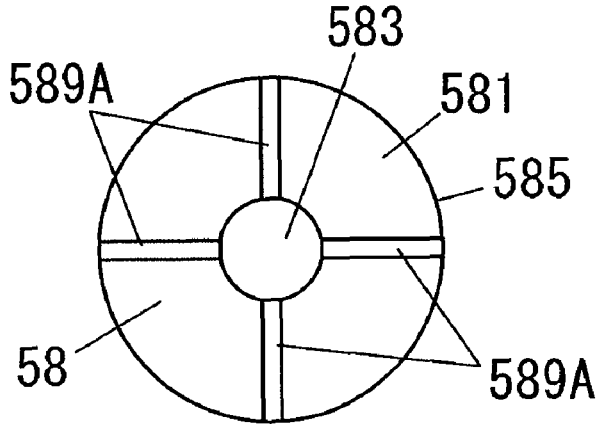
FIG. 18B is a front view illustrating the modification of the shock absorber of the above contact device of FIG. 18A.
Figure 18A:
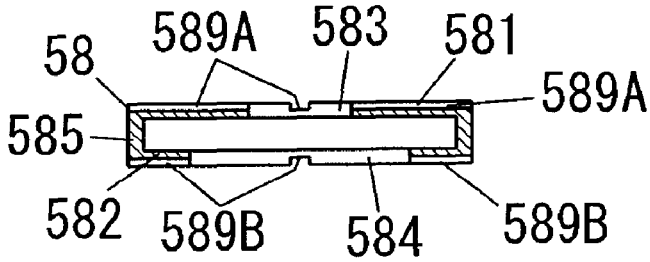
FIG. 18A is a cross sectional view illustrating a modification of the shock absorber of the above contact device.
Figure 18C:
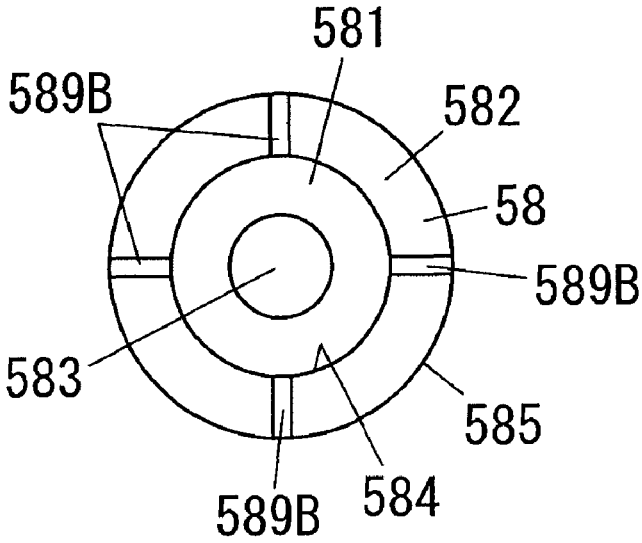
FIG. 18C is a rear view illustrating the modification of the shock absorber of the above contact device of FIG. 18A.
Figure 19B:
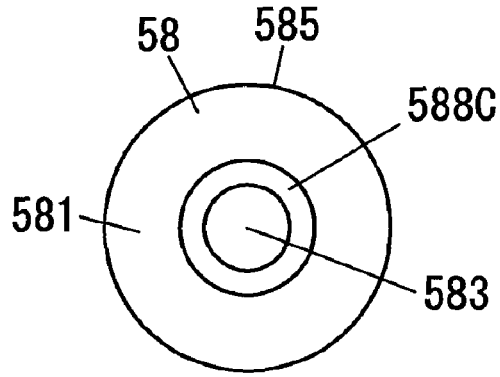
FIG. 19B is a front view illustrating the modification of the shock absorber of the above contact device of FIG. 19A.
Figure 19A:
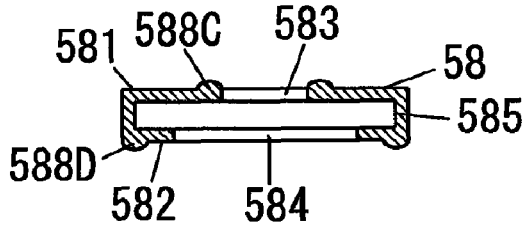
FIG. 19A is a cross sectional view illustrating a modification of the shock absorber of the above contact device.
Figure 19C:
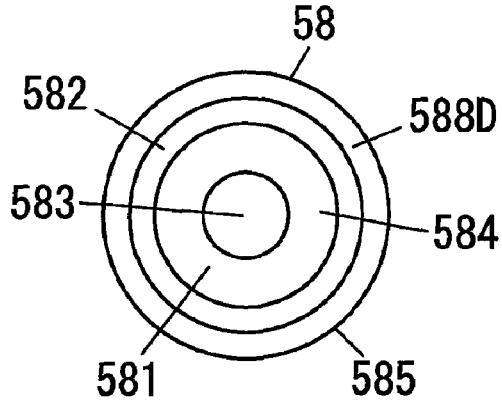
FIG. 19C is a rear view illustrating the modification of the shock absorber of the above contact device of FIG. 19A.
Figure 19D:
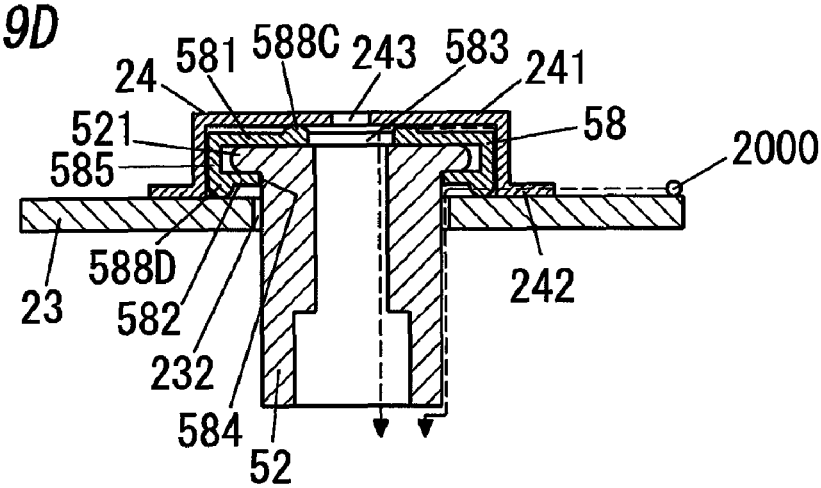
FIG. 19D is a cross sectional view illustrating a situation where the modification of the shock absorber of the above contact device of FIG. 19A is attached to the fixed core.

In the shock absorber 58 shown in FIG. 18, the first resilient portion 581 is provided in its front surface with four recessed portions 589A. The recessed portions 589A are arranged at regular intervals along a circumferential direction of the first resilient portion 581. In addition, the second resilient portion 582 is provided in its rear surface with four recessed portions 589B. The recessed portions 589B are arranged at regular intervals along a circumferential direction of the second resilient portion 582. Besides, the number of the recessed portions 589A and the number of the recessed portions 5896 are not limited to four. For example, the number of the recessed portions 589A and the number of the recessed portions 589B may be one to three, or more than four.

Also according to the shock absorber 58 shown in FIG. 18, the recessed portions 589A decrease the contact area of the first resilient portion 581 and the cap 24 relative to that of the shock absorber 58 shown in FIG. 16, and the recessed portions 589B decrease the contact area of the second resilient portion 582 and the closure plate 23 relative to that of the shock absorber 58 shown in FIG. 16. Therefore, according to the contact device 10 having the shock absorber 58 shown in FIG. 18, it is possible to more reduce the operation noise of the contact device 10.

In brief, it is sufficient that the protruded portions 588A or the recessed portions 589A are provided to a surface of the first resilient portion 581 opposed to the cap 24 and that the protruded portions 588B or the recessed portions 589B are provided to a surface of the second resilient portion 582 opposed to the closure plate 23.

In the shock absorber 58 shown in FIG. 19, the first resilient portion 581 is provided on its front surface (surface opposed to the cap 24) with a protruded portion 588C, and the second resilient portion 582 is provided on its rear surface (surface opposed to the closure plate 23) with a protruded portion 588D. The protruded portion 588C, being of an annular shape, extends around an inner periphery of the first resilient portion 581. This protruded portion 588C is defined as a periphery wall surrounding the through hole 583. The protruded portion 588D, being of an annular shape, extends around an inner periphery of the second resilient portion 582. This protruded portion 588D is defined as a periphery wall surrounding the through hole 584.

In brief, it is sufficient that the first resilient portion 581 includes a periphery wall surrounding the through hole 582 and that the second resilient portion 582 includes a periphery wall surrounding the through hole 584.

In the shock absorber 58 shown in FIG. 19, the protruded portion 588C comes into contact with the cap 24 and the protruded portion 588D comes into contact with the closure plate 23.

Therefore, it is possible to prevent a dust 2000 from coming into the inside of the case 25 (especially, a clearance between the fixed core 52 and the movable core 54) via the through holes 583 and 584. Thus, it is possible to improve reliability of an on-off operation of the contact device 10. For example, the dust 2000 is dissipation particles generated by contact of the contact portion 41 with the fixed contact 31 or by separation of the contact portion 41 from the fixed contact 30.

By the way, in the contact device 10 of the present embodiment, the screw hole 33 is provided to the fixed terminal 30 in order to fix the external connection terminal 34 to the fixed terminal 30. Therefore, a process of forming the screw hole 33 in the fixed terminal 30 is necessary. Generally, since the process of forming the screw hole 33 costs time, the production cost increases. Additionally, the fixed terminal 30 needs to be designed to have its diameter greater than a diameter of screw hole 33 (diameter of the fixed screw). Therefore, the fixed terminal 30 sees reduced design flexibility Consequently, in a modification of the contact device 10 shown in FIG. 20, the fixed terminal 30 has its front end with a deformation portion 35 instead of the screw hole 33. Meanwhile, the external connection terminal 34 is provided with an insertion hole 341 having a circular shape. Prior to attaching the external connection terminal 34 to the fixed terminal 30, the deformation portion 35 keeps its original columnar shape with its outer diameter being smaller than an inner diameter of the insertion hole 341.

Figure 21A:
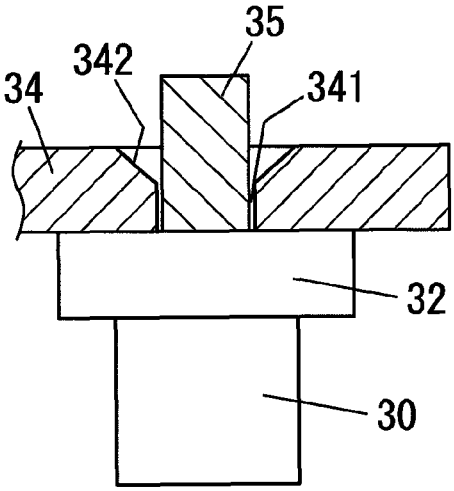
FIG. 21A is an explanatory view illustrating a method of attaching an external connection terminal to a fixed terminal of the modification of the above contact device of FIG. 20A.
Figure 21B:
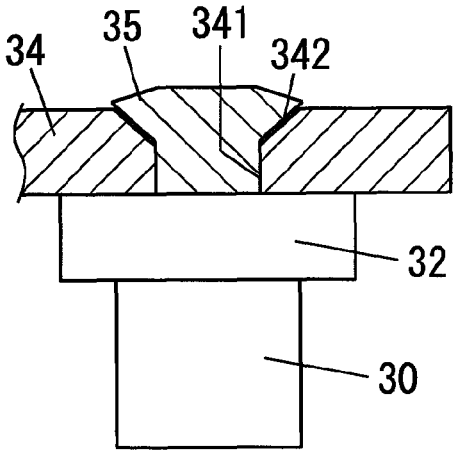
FIG. 21B is an explanatory view illustrating the method of attaching the external connection terminal to the fixed terminal of the modification of the above contact device of FIG. 20A.

When the external connection terminal 34 is attached to the fixed terminal 30, first, the deformation portion 35 is inserted into the insertion hole 341 of the external connection terminal 34 as shown in FIG. 21A. Next, as shown in FIG. 21B, the deformation portion 35 is plastically deformed to come into close contact with an inner periphery of the insertion hole 341. In other words, the deformation portion 35 and the insertion hole 341 are used for riveting (e.g. spin riveting and radial riveting). In a situation shown in FIG. 21B, a most part of the deformation portion 35 is plastically deformed. However, a part of the deformation portion 35 which comes into contact with inner periphery of the insertion hole 341 is elastically deformed, rather than is plastically deformed. Therefore, the deformation portion 35 comes into strongly close contact with the inner periphery of the insertion hole 341. Thus, the external connection terminal 34 is fixed successfully to the fixed terminal 30. Additionally, conduction between the external connection terminal 34 and the fixed terminal 30 is successfully made because contact resistance between the external connection terminal 34 and the fixed terminal 30 decreases.

Figure 20A:
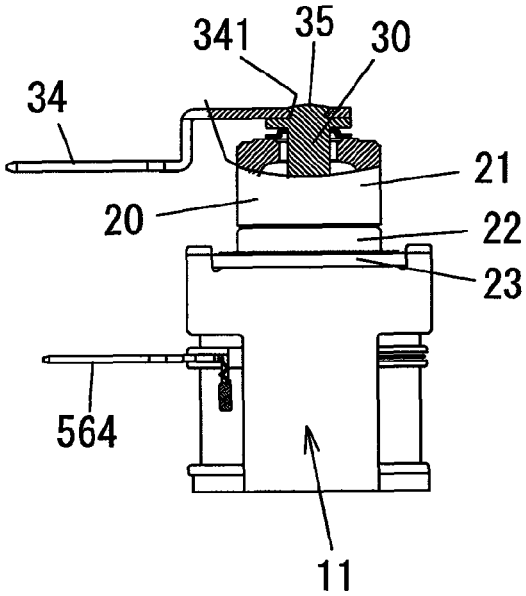
FIG. 20A is a schematic view illustrating a modification of the above contact device.
Figure 20B:
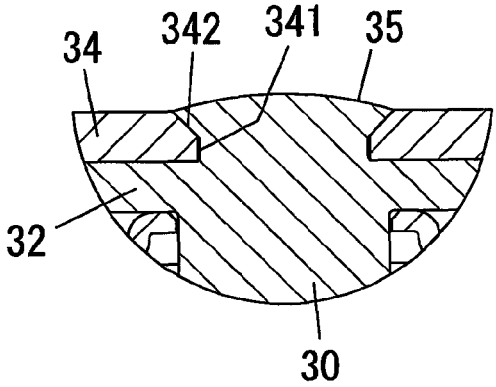
FIG. 20B is an enlarged view illustrating the modification of the above contact device of FIG. 20A.

As mentioned in the above, in the modification shown in FIG. 20, the fixed terminal 30 is provided with the deformation portion 35 at its front end. The deformation portion 35 is plastically deformed to fix the external connection terminal 34 to the fixed terminal 30. That is, the fixed terminal 30 is secured to the external connection terminal 34 by plastically and elastically deforming a part of the fixed terminal 30. Therefore, the external connection terminal 34 is not necessitated to be screwed to the fixed terminal 30. According to the modification shown in FIG. 20, the process of forming the screw hole 33 in the fixed terminal 30 can be eliminated, and therefore the production cost can be reduced. Additionally, it is possible to improve the flexibility of the design of the fixed terminal 30 because the diameter of the fixed terminal 30 is independent from the diameter of the screw hole 33.

Especially, the deformation portion 35 is a protrusion extending from the fixed terminal 30 toward the external connection terminal 34. The insertion hole 341 defined as an insertion portion into which the deformation portion 35 is inserted is formed in the external connection terminal 34. Therefore, the external connection terminal 34 can be riveted to the fixed terminal 30 with the deformation portion 35 being inserted into the insertion hole 341 followed by being plastically deformed. Consequently, the external connection terminal 34 can be easily fixed to the fixed terminal 30.

Figure 22A:
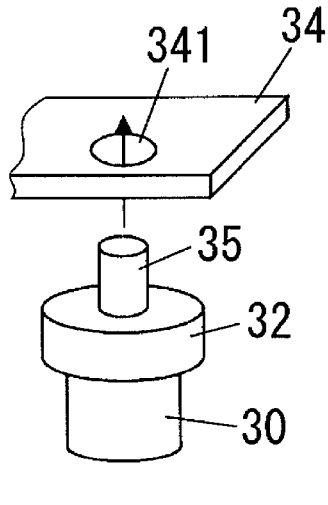
FIG. 22A is an explanatory view illustrating a method of attaching the external connection terminal to the fixed terminal of a modification the above contact device.
Figure 22B:
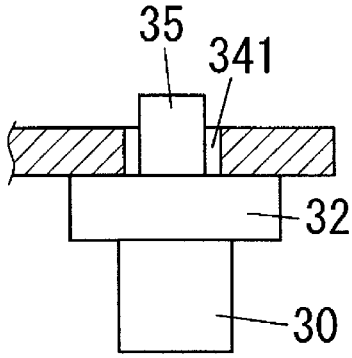
FIG. 22B is an explanatory view illustrating the method of attaching the external connection terminal to the fixed terminal of the modification the above contact device of FIG. 22A.
Figure 22C:
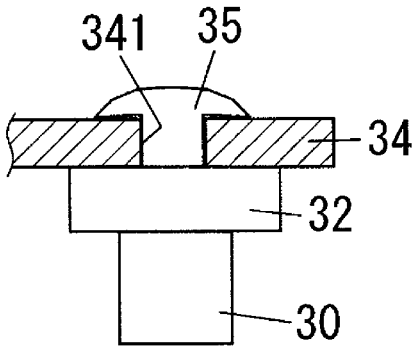
FIG. 22C is an explanatory view illustrating the method of attaching the external connection terminal to the fixed terminal of the modification the above contact device of FIG. 22A.

In addition, a tapered surface 342 is formed in a periphery of the insertion hole 341. The tapered surface 342 expands the insertion hole 341 to be greater towards its front side (side opposed to the fixed core 30) than at its rear end. Therefore, when the deformation portion 35 is plastically deformed, the deformation portion 35 is deformed to come into close contact with the tapered surface 342. A contact area between the external connection terminal 34 and the deformation portion 35 can be increased by forming the tapered surface 342. Consequently, it is possible to prevent the external connection terminal 34 from rotating around the deformation portion 35. Further, the contact resistance between the external connection terminal 34 and the fixed terminal 30 can be more decreased. It is noted that the tapered surface 342 does not need to be formed in the external connection terminal 34 (see FIGS. 22A to 22C). However, in view of the above merits, the tapered surface 342 is preferred to be formed.

Figure 23A:
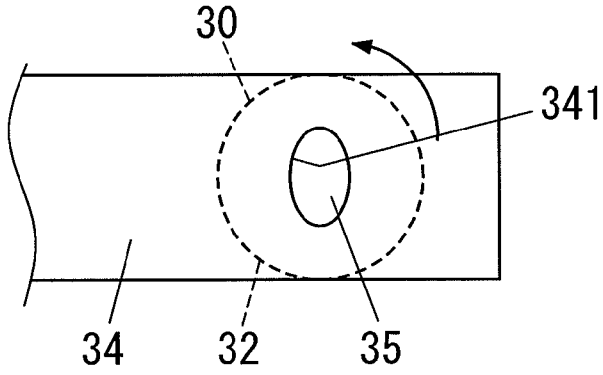
FIG. 23A is a partial plan view illustrating a modification of the external connection terminal of the above contact device.
Figure 23B:
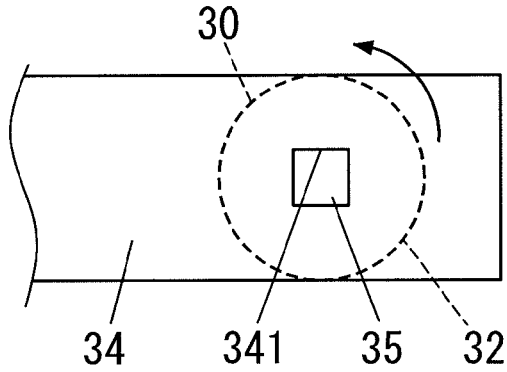
FIG. 23B is a partial plan view illustrating a modification of the external connection terminal of the above contact device.
Figure 23C:
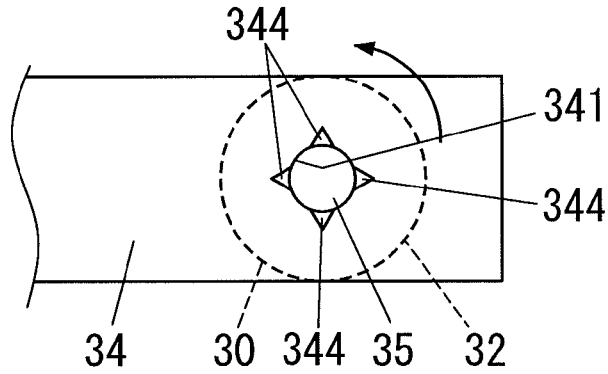
FIG. 23C is a partial plan view illustrating a modification of the external connection terminal of the above contact device.
Figure 23D:
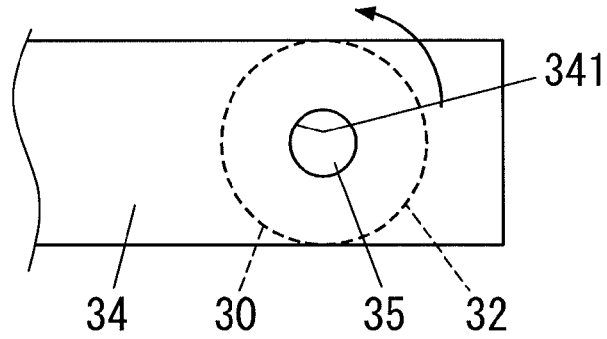
FIG. 23D is a partial plan view illustrating a modification of the external connection terminal of the above contact device.

In an instance shown in FIG. 23D, a junction between the fixed terminal 30 and the external connection terminal 34 has poor resistance to a stress applied along a circumference direction of the insertion hole 341. This is caused by the inner peripheral shape of the insertion hole 341 of the external connection terminal 34 being a precise circular shape. In the instance shown in FIG. 23D, when stress is applied along the circumference direction of the insertion hole 341 to the external connection terminal 34, the external connection terminal 34 is likely to rotate around the fixed terminal 30.

In view of the above, as shown in FIG. 23A, the insertion hole 341 may have its inner peripheral shape being an elliptical shape. With this arrangement, the junction between the fixed terminal 30 and the external connection terminal 34 has excellent resistance to a moment developed about an central axis of the fixed terminal 30 (i.e., the stress applied along the circumference direction of the insertion hole 341). Therefore, it is possible to prevent the external connection terminal 34 from rotating around the fixed terminal 30.

Shapes of the insertion hole 341 and the deformation portion 35 are not limited in the aforementioned instance. For example, as shown in FIG. 23B, the insertion hole 341 may have its inner periphery of a rectangular shape (regular tetragon shape, in the illustrated instance). Alternately, as shown in FIG. 23C, plural (four, in the illustrated instance) cutouts 344 may be formed in the inner periphery of the insertion hole 341 having a precise circular inner periphery, and may be arranged at regular intervals along the circumference direction of the insertion hole 341. In brief, when the inner peripheral shape of the insertion hole 341 is selected from any one of shapes but the precise circular shape, it is possible to prevent the external connection terminal 34 from rotating relative to the fixed terminal 30.

Figure 22D:
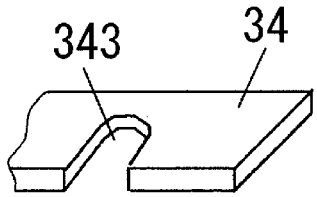
FIG. 22D is a perspective view illustrating a modification of the external connection terminal of the above contact device.

By the way, as shown in FIG. 22D, instead of the insertion hole 341, a cutout 343 may be formed in the external connection terminal 34. The cutout 343 communicates with an outside of the external connection terminal 34 at one width end of the external connection terminal 34. Also in this situation, the external connection terminal 34 can be fixed to the fixed terminal 30 by use of the deformation portion 35 and the cutout 343. Especially, it is possible to improve workability of the riveting process, because the deformation portion 35 can easily pass through the cutout 343 rather than the insertion hole 341.

Figure 24A:
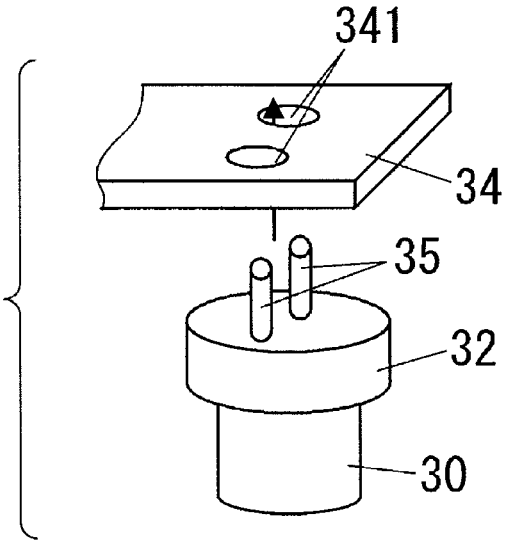
FIG. 24A is an explanatory view illustrating a method of attaching the external connection terminal to the fixed terminal of a modification the above contact device.
Figure 24B:
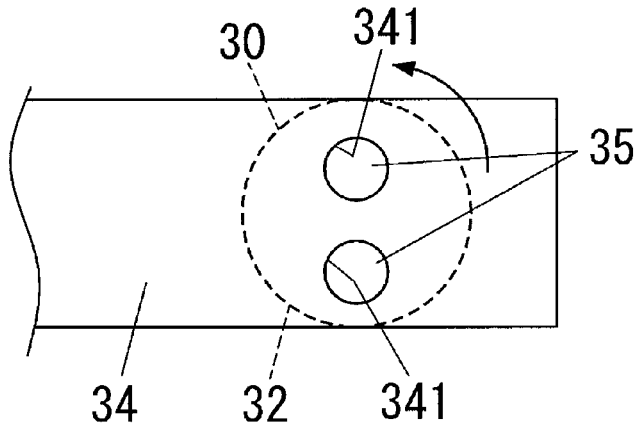
FIG. 24B is an explanatory view illustrating the method of attaching the external connection terminal to the fixed terminal of the modification the above contact device of FIG. 24A.

In a modification shown in FIGS. 24A and 24B, the fixed terminal 30 is provided at its front end with two deformation portions 35. Additionally, the external connection terminal 34 includes two insertion holes 341 respectively corresponding to the two deformation portions 35.

Figure 24C:
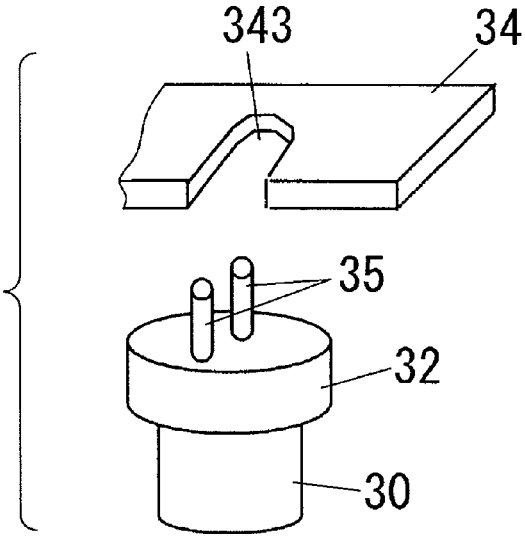
FIG. 24C is a perspective view illustrating the modification of the external connection terminal of the above contact device of FIG. 22D.

With this arrangement, it is possible to prevent the external connection terminal 34 from rotating around the fixed terminal 30. Besides, as shown in FIG. 24C, the cutout 343 may be formed instead of the two insertion holes 341. Also with this arrangement, the external connection terminal 34 is fixed to the fixed terminal 30 by use of the two deformation portions 35 and the cutout 343. Especially, it is possible to improve workability of the riveting process, because the deformation portion 35 can easily pass through the cutout 343 rather than the insertion hole 341. Besides, the number of the deformation portions 35 and the number of the insertion holes 341 may be three or more.

In another respect, the aforementioned contact device 10 of the present embodiment is defined as follows. That is, the contact device 10 includes the sealed receptacle 20 configured to house the fixed contact 31 and the movable contact 40, and the drive unit 50 configured to move the movable contact 40 between the on-position where the movable contact 40 is kept in contact with the fixed contact 31 and the off-position where the movable contact 40 is kept away from the fixed contact 31. The sealed receptacle 20 includes the case 21 made of dielectric materials and the closure plate 23. The case 21 is provided with the aperture 211 in its rear wall (first wall). The closure plate 23 is secured in an airtight manner to the periphery of the aperture 211 of the case 21. The fixed contact 31 is fixed to the front wall (second wall) of the case 21 which is opposed to the rear wall of the case 21. The movable contact 40 is interposed between the fixed contact 31 and the closure plate 23. The drive unit 50 includes the shaft 53, and the actuator including the fixed core 52 penetrating through the closure plate 23, the movable core 54, and the electromagnet device 56. The shaft 53 is disposed to penetrate through the movable contact 40 and the fixed core 52. The shaft 53 is provided at its front end (first end) inside the sealed receptacle 20 with the latch 531 coming into contact with the fixed contact 31 side surface of the movable contact 40. The shaft 53 has its rear end (second end) outside the sealed receptacle 20 coupled (secured) to the movable core 40. The electromagnet device 56 is configured to generate a magnetic attraction between the fixed core 52 and the movable core 54. The aforementioned actuator is configured to control the electromagnet device 56 to move the shaft 53 along its axial direction between the position where the latch 531 separates the movable contact 40 from the fixed contact 31 and the position where the latch 531 allows the movable contact 40 to come into contact with the fixed contact 31. The fixed core 52 is provided with the flange 521 configured to be hooked over the periphery of the through hole 232 of the closure plate 23 through which the fixed core 52 penetrates. The contact device 23 includes the cap 24 secured to the closure plate 23 such that the flange 521 of the fixed core 52 is held between the cap 24 and the closure plate 23. The contact device 10 further includes the shock absorber 58. The shock absorber 58 includes the first resilient portion 581, the second resilient portion 582, and the connection portion 585. The first resilient portion 581 is interposed between the flange 521 of the fixed core 52 and the cap 24. The second resilient portion 582 is interposed between the flange 521 of the fixed core 52 and the closure plate 23. The connection portion 585 is configured to integrally connect the outer edge of the first resilient portion 581 to the outer edge of the second resilient portion 582.

Therefore, according to the contact device 10, it is unnecessary to attach individually the first resilient portion 581 and the second resilient portion 582 to the fixed core 52. Thus, the shock absorber 58 can be easily attached to the fixed core 52. Moreover, since the first resilient portion 581 and the second resilient portion 582 which each have poor manipulability are integrally connected to each other through the connection portion, it is easy to manipulate the shock absorber 58.

In another respect, the aforementioned contact device 10 of the present embodiment is defined as follows. That is, the contact device 10 includes the contacts mechanism unit 11, the extinguishing unit 12, and the housing 13. The contacts mechanism unit 11 includes the sealed receptacle 20 and the drive unit 50. The sealed receptacle 20 is configured to house the fixed contact 31 and the movable contact 40. The drive unit 50 is configured to move the movable contact 40 between the on-position where the movable contact 40 is kept in contact with the fixed contact 31 and the off-position where the movable contact 40 is kept away from the fixed contact 31. The extinguishing unit 12 includes the pair of the permanent magnets 121 and the yoke 122 configured to hold the pair of the permanent magnets 121. The permanent magnets 121 in the pair are arranged on opposite sides of the sealed receptacle 20 with respect to the direction crossing with the direction along which the movable contact 40 moves toward and away from the fixed contact 31. The housing 13 includes the base 70 on which the contacts mechanism unit 11 is mounted, and the cover 80 configured to be attached to the base 80 such that the contacts mechanism unit 11 and the extinguishing unit 12 are housed between the base 70 and the cover 80. The any one of the yoke 122 and the base 70 is provided with the attachment protrusion with the other being provided with the attachment recess configured to receive the attachment protrusion.

According to this configuration, the contact device 10 can be easily assembled.

In another respect, the contact device 10 shown in FIG. 20 is defined as follows. That is, the contact device 10 includes a sealed unit and the drive unit 50. The sealed unit includes the fixed contact 31, the movable contact 40, and the sealed receptacle 20 configured to house the fixed contact 31 and the movable contact 40. The drive unit 50 is configured to move the movable contact 40 between the on-position where the movable contact 40 is kept in contact with the fixed contact 31 and the off-position where the movable contact 40 is kept away from the fixed contact 31. The sealed unit includes the fixed terminal 30 penetrating through the wall (front wall) of the sealed receptacle 20, and the external connection terminal 34 adapted to be connected to an external circuit. The fixed terminal 30 is provided with the fixed contact 31 at its rear end (first end) inside the sealed receptacle 20. In addition, the fixed terminal 30 is provided with the deformation portion 35 at its front end (second end) outside the sealed receptacle 20. The deformation portion 35 is adapted to be plastically deformed to connect the external connection terminal 34 to the fixed terminal 30.

Therefore, according to the contact device 10 shown in FIG. 20, the external connection terminal 34 is not necessitated to be screwed to the fixed terminal 30. Thus, the process of forming the screw hole 33 in the fixed terminal 30 can be eliminated, and therefore the production cost can be reduced. Additionally, it is possible to improve the flexibility of the design of the fixed terminal 30 because the diameter of the fixed terminal 30 is independent from the diameter of the screw hole 33.

The invention claimed is:

1. A contact device comprising:

a sealed receptacle configured to house a fixed contact, a movable contact, and an arc protection member; and a drive unit configured to move said movable contact between an on position where said movable contact is kept in contact with said fixed contact and an off position where said movable contact is kept away from said fixed contact, wherein said sealed receptacle includes:

a case made of dielectric materials, said case being provided with an aperture in its first wall;

a cylindrical member made of metals, said cylindrical member having its first axial end secured in an airtight manner to a periphery of said aperture of said case; and a closure plate secured in an airtight manner to a second axial end of said cylindrical member, said fixed contact being fixed to a second wall of said case which is opposed to said first wall of said case, said movable contact being interposed between said fixed contact and said closure plate, said arc protection member including a peripheral wall configured to conceal a junction between said case and said cylindrical member from said fixed contact and said movable contact, said arc protection member including a bottom interposed between said movable contact and said closure plate, said drive unit including a contact pressure provision member biasing said movable contact such that said movable contact comes into contact with said fixed contact, and said contact pressure provision member being interposed between said movable contact and said bottom of said arc protection member, said contact provision member being in resilient contact with both said movable contact and said bottom of said arc protection, member irrespective of a position of said movable contact.

2. A contact device as set forth in claim 1, wherein said drive unit includes a shaft and an actuator, said shaft being disposed so as to penetrate through said movable contact, said bottom of said arc protection member, and said closure plate, said shaft being provided at its first end inside said sealed receptacle with a latch coming into contact with a fixed contact side surface of said movable contact, said shaft having its second end outside said sealed receptacle coupled to said actuator, said actuator being, configured to move said shaft along its axial direction between a position where said latch separates said movable contact from said fixed contact and a position where said latch allows said movable contact to conic into contact with said fixed contact, said sealed receptacle being, configured to house a dust prevention member configured to cover a clearance between said shaft and a periphery of a through hole for said shaft formed in said bottom of said arc protection member, and said dust prevention member including a flange interposed between said contact pressure provision member and said bottom of said arc protection member.

3. A contact device as set forth in claim 1, wherein any one of said closure plate and said bottom of said arc protection member includes a protrusion for positioning with the other including a recess for positioning configured to receive said protrusion for positioning.

4. A contact device as set forth in claim 3, wherein said contact device includes a plurality of said protrusions for positioning and a plurality of said recesses for positioning respectively corresponding to said plurality of said protrusions for positioning.

5. A contact device as set forth in claim 1, wherein said drive unit comprises a shaft, and an actuator including a fixed core penetrating through said closure plate, a movable core, and an electromagnet device, said shaft being disposed to penetrate through said movable contact, said bottom of said arc protection member, and said fixed core, said shaft being provided at its first end inside said sealed receptacle with a latch coming into contact with a fixed contact side surface of said movable contact, said shaft having its second end outside said sealed receptacle secured to said movable core, said electromagnet device being configured to generate a magnetic attraction between said fixed core and said movable core, said actuator being configured to control said electromagnet device to move said shaft along its axial direction between a position where said latch separates said movable contact from said fixed contact and a position where said latch allows said movable contact to come into contact with said fixed contact, said contact device including a cap configured to fix said fixed core to said closure plate, said cap being secured to a surface of said closure plate opposed to said bottom of said arc protection member, and any one of said cap and said bottom of said arc protection member including a protrusion for positioning with the other including a recess for positioning configured to receive said positioning protrusion.

6. A contact device as set forth in claim 5, wherein said contact device includes a plurality of said protrusions for positioning and a plurality of said recesses for positioning respectively corresponding to said plurality of said protrusions for positioning.

7. A contact device as set forth in claim 1, wherein said drive unit comprises a shaft, and an actuator including a fixed core penetrating through said closure plate, a movable core, and an electromagnet device, said shaft being disposed to penetrate through said movable contact, said bottom of said arc protection member, and said fixed core, said shaft being provided at its first end inside said sealed receptacle with a latch coming into contact with a fixed contact side surface of said movable contact, said shaft having its second end outside said sealed receptacle secured to said movable core, said electromagnet device being configured to generate a magnetic attraction between said fixed core and said movable core, said actuator being configured to control said electromagnet device to move said shaft along its axial direction between a position were said latch separates said movable contact from said fixed contact and a position where said latch allows said movable contact to come into contact with said fixed contact, said contact device including a cap configured to fix said fixed core to said closure plate, said cap being secured to a surface of said closure plate opposed to said bottom of said arc protection member, said closure plate being provided with a first protrusion for positioning, said cap being provided with a second protrusion for positioning, and said arc protection member being provided in its bottom with a first recess for positioning configure to receive said first protrusion and a second recess for positioning configured to receive a second protrusion.

8. A contact device as set forth in claim 1, wherein said bottom of said arc protection unit having a positioning portion configured to surround said contact pressure provision member.

9. A contact device as set forth in claim 8, wherein said positioning portion has its inner surface inclined such that it distance between said inner surface and said contact pressure provision member increases as a distance from said bottom increases.

10. A contact device as set forth in claim 1, wherein said contact pressure provision member is a coil spring, and said arc protection member being provided on its bottom with a positioning portion configured to intrude into said contact pressure provision member.

11. A contact device as set forth in claim 10, wherein said positioning portion has its outer surface inclined such that a distance between said outer surface and said contact pressure provision member increases as a distance from said bottom increases.

12. A contact device comprising:

a sealed receptacle configured to house a fixed contact, and a movable contact; and a drive unit configured to move said movable contact between an on position where said movable contact is kept in contact with said fixed contact and an off position where said movable contact is kept away from said fixed contact, wherein said sealed receptacle includes:

a case made of dielectric materials, said case being provided with an aperture in its first wall; and a closure plate secured in an airtight manner to a periphery of said aperture of said case, said fixed contact being fixed to a second wall of said case which is opposed to said first wall of said case, said movable contact being interposed between said fixed contact and said closure plate, said drive unit comprising a shaft, and an actuator including a fixed core penetrating through said closure plate, a movable core, and an electromagnet device, said shaft being disposed to penetrate through said movable contact, and said fixed core, said shaft being provided at its first end inside said sealed receptacle with a latch coming into contact with a fixed contact side surface of said movable contact, said shaft having its second end outside said sealed receptacle secured to said movable core, said electromagnet device being configured to generate a magnetic attraction between said fixed core and said movable core, said actuator being configured to control said electromagnet, device to move said shalt along its axial direction between a position where said latch separates said movable contact from said fixed contact and a position where said latch allows said movable contact to come into contact with said fixed contact, said fixed core being provided with a flange configured to be hooked over a periphery of a through hole of said closure plate through which said fixed core penetrates, said contact device including a cap secured to said closure plate such that said flange of said fixed core is held between said cap and said closure plate, said contact device including a shock absorber, said shock absorber comprising:

a first resilient portion interposed between said flange of said fixed core and said cap;

a second resilient portion interposed between said flange of said fixed core and said closure plate; and a connection portion integrally connecting an outer edge of said first resilient portion to an outer edge of said second resilient portion.

13. A contact device comprising:

a contacts mechanism unit including a sealed receptacle and a drive unit, said sealed receptacle configured to house a fixed contact and a movable contact, and said drive unit being configured to move said movable contact between an on position where said movable contact is kept in contact with said fixed contact and an oil position where said movable contact is kept away from said fixed contact;

an extinguishing unit including a pair of permanent magnets and a yoke configured to hold said pair of said permanent magnets, said permanent magnets in said pair being arranged on opposite sided of said sealed receptacle with respect to a direction crossing a direction along which said movable contact moves toward and away from said fixed contact; and, a housing including a base on which said contacts mechanism unit is mounted, and a cover configured to attached to said base such that said contacts mechanism unit and said extinguishing unit are housed between said base and said cover, and wherein any one of said yoke and said base is provided with an attachment protrusion with the other being provided with an attachment recess configured to receive said attachment protrusion.

14. A contact device comprising:

a sealed unit including a fixed contact, a movable contact, and a sealed receptacle configured to house said fixed contact and said movable contact; and a drive unit configured to move said movable contact between an on position where said movable contact is kept in contact with said fixed contact and an off position where said movable contact is kept away from said fixed contact, wherein said sealed unit includes a fixed terminal penetrating through a wall of said sealed receptacle, and an external connection terminal adapted to be connected to an external circuit, said fixed terminal being provided with said fixed contact at its first end inside said sealed receptacle, said fixed terminal being provided with a deformation portion at its second end outside said sealed receptacle, and said deformation portion being plastically deformed and connecting said fixed terminal to said external connection terminal.

* * * * *